US011004368B2

(12) United States Patent
Dalton

(10) Patent No.: US 11,004,368 B2
(45) Date of Patent: May 11, 2021

(54) EASEL

(71) Applicant: SignsDirect Inc., Bloomington, IL (US)

(72) Inventor: Thomas Dalton, Heyworth, IL (US)

(73) Assignee: SignsDirect Inc., Bloomington, IL (US)

( * ) Notice: Subject to any disclaimer, the term of this patent is extended or adjusted under 35 U.S.C. 154(b) by 9 days.

(21) Appl. No.: 16/397,167

(22) Filed: Apr. 29, 2019

(65) Prior Publication Data

US 2020/0342794 A1 Oct. 29, 2020

(51) Int. Cl.
*G09F 15/00* (2006.01)
*A47B 97/08* (2006.01)

(52) U.S. Cl.
CPC ..... *G09F 15/0062* (2013.01); *A47B 97/08* (2013.01); *G09F 15/0018* (2013.01)

(58) Field of Classification Search
CPC .. G09F 15/0062; G09F 15/0018; A47B 97/08
USPC ..... 248/459; 40/124.09–124.19; 229/103.3, 229/115, 116, 71
See application file for complete search history.

(56) References Cited

U.S. PATENT DOCUMENTS 1,115,021 A * 10/1914 Pummill ..... G09F 15/0062 40/610
4,269,348 A * 5/1981 Young ..... B65D 5/4616 229/115
4,928,415 A * 5/1990 Walters ..... G09F 1/06 40/610
5,358,762 A * 10/1994 McGrath ..... G09F 15/0062 40/610
5,621,992 A * 4/1997 Mandell ..... G09F 15/0062 116/63 P
5,675,923 A * 10/1997 Sarkisian ..... G09F 7/12 40/611.01
6,003,257 A * 12/1999 Stokes ..... G09F 15/0062 40/455
7,337,569 B2 3/2008 Glass
7,886,467 B2 2/2011 Glass
(Continued)

OTHER PUBLICATIONS

Photograph 1.
Photograph 2.

*Primary Examiner* — Muhammad Ijaz
(74) *Attorney, Agent, or Firm* — Banner & Witcoff, Ltd.

(57) ABSTRACT

An easel is disclosed, where the easel may comprise a center front panel, a center rear panel positioned adjacent a top edge of the center front panel, a left front side panel positioned adjacent the center front panel, a right front side panel positioned adjacent the center front panel opposite the left front side panel, a right rear side panel positioned adjacent the center rear panel, a left rear side panel positioned adjacent the center rear panel opposite the right rear side panel. A first right slot may be positioned between the center rear panel and the right rear side panel, and a first left slot may be positioned between the center rear panel and the left rear side panel. Each of the center front panel and the center rear panel may include a pair of flaps configured to removably secure a sign. The easel may also have a presentation configuration and an unfolded configuration. When the easel is in the presentation configuration, the easel may form an A-frame structure, and when the easel is in the unfolded configuration, the center front panel and the center rear panel may be arranged substantially parallel to each other.

20 Claims, 25 Drawing Sheets

(56) References Cited

U.S. PATENT DOCUMENTS 8,052,103 B2 * 11/2011 Ferraro ..... G09F 1/14
248/174
9,286,814 B1 * 3/2016 Thomaselli ..... E01F 9/012

* cited by examiner

EASEL

TECHNICAL FIELD

Aspects of the disclosure relate to apparatuses for signs, such as easels or sign holders for stationary signs.

BACKGROUND

Conventional easels or sign holders may often be cumbersome and difficult to set up. In addition, some sandwich board signs or easels may require tape, glue, or other means to secure a sign. An easel that can be easily set up and secure a sign without any additional materials would be helpful.

SUMMARY

This Summary introduces some general concepts relating to this disclosure in a simplified form that are further described below in the Detailed Description. This Summary is not intended to identify key features or essential features of the disclosure.

In some examples, the disclosure may relate to an easel comprising a center front panel, a center rear panel positioned adjacent a top edge of the center front panel, a left front side panel positioned adjacent the center front panel, a right front side panel positioned adjacent the center front panel opposite the left front side panel, a right rear side panel positioned adjacent the center rear panel, a left rear side panel positioned adjacent the center rear panel opposite the right rear side panel. The right front side panel may have a first right tab, and the left front side panel may have a first left tab. A first right slot may be positioned between the center rear panel and the right rear side panel, and a first left slot may be positioned between the center rear panel and the left rear side panel. Each of the center front panel and the center rear panel may include a pair of flaps oriented substantially parallel to each other and may be configured to removably secure a sign. The easel may have a presentation configuration and an unfolded configuration, where when in the presentation configuration, the easel may form an A-frame structure with the first right tab inserted into the first right slot and the first left tab inserted into the first left slot. When in the unfolded configuration, the center front panel and the center rear panel are arranged substantially parallel to each other. The sign may be a poster type sign. Each flap of the pair of flaps on the center front panel may have a width that extends within a range of 60 percent and 85 percent of an overall width of the center front panel. In addition, each flap of the pair of flaps on the center front panel comprises a fixed end along a flap fold line and a free end spaced away from the fixed end. The flap fold line may be at least partially perforated, or in some embodiments, the flap fold line may be a compressed region. The easel may be formed as a unitary member such that the center front panel, the center rear panel, the left front side panel, the right front side panel, the right rear side panel, and the left rear side panel have substantially the same thickness. The center front panel may have a thickness within a range of 0.09 inches and 0.25 inches, and may further comprise a lower opening between a pair of feet.

Other aspects of this disclosure may relate to an easel comprising a center front panel comprising a substantially rectangular shape, where a height of the center front panel is greater than a width of the center front panel. The center front panel may also include an upper flap and a lower flap oriented substantially parallel to each other and configured to removably secure a sign, where the upper flap has a fixed end along an upper flap fold line and a free end spaced inward from the fixed end, wherein the lower flap has a fixed end along an lower flap fold line and a free end spaced inward from the fixed end. The easel may also include a center rear panel adjacent a top edge of the center front panel with a substantially rectangular shape, where a central fold line is arranged between the center front panel and the center rear panel. The easel may have a presentation configuration and an unfolded configuration, where when in the presentation configuration, the easel forms an A-frame structure, and when in the unfolded configuration, the center front panel and the center rear panel are substantially parallel to each other. The central fold line may be at least a partially perforated region, while the lower flap fold line may be a compress region. The easel may be formed as a unitary member. The distance between the upper flap fold line and the lower flap fold line may be within a range of 12 inches and 32 inches. In addition, the easel may comprise a plurality of feet arranged at each corner of the easel, where at least one foot of the plurality of feet is formed by a portion of the center front panel and a portion of a left side panel. A first foot of the plurality of feet may be separated from a second foot by a lower central opening on the center front panel.

Still other aspects of this disclosure may relate to an easel comprising a center front panel, a center rear positioned panel adjacent a top edge of the center front panel, a left front side panel positioned adjacent the center front panel, a right front side panel positioned adjacent the center front panel opposite the left front side panel, a right rear side panel adjacent the center rear panel, a left rear side panel positioned adjacent the center rear panel opposite the right rear side panel. The right front side panel may have a first right tab, and the left front side panel may have a first left tab. A first right slot may be positioned between the center rear panel and the right rear side panel, and a first left slot may be positioned between the center rear panel and the left rear side panel. The center front panel may include an upper flap and a lower flap oriented substantially parallel to each other and configured to removably secure a first sign, where the upper flap has a fixed end along an upper flap fold line and a free end spaced inward from the fixed end, and where the lower flap has a fixed end along a lower flap fold line and a free end spaced inward from the fixed end. The center rear panel may include an upper flap and a lower flap oriented substantially parallel to each other and configured to removably secure a second sign, where the upper flap has a fixed end along an upper flap fold line and a free end spaced inward from the fixed end, and where the lower flap has a fixed end along an lower flap fold line and a free end spaced inward from the fixed end. The easel may have a presentation configuration and an unfolded configuration. When in the presentation configuration, the easel may form an A-frame structure, where the first right tab is inserted into the first right slot and the first left tab is inserted into the first left slot, and when in the unfolded configuration, the center front panel and the center rear panel may be substantially parallel to each other. The center front panel, the center rear panel, the left front side panel, the right front side panel, the right rear side panel, and the left rear side panel may have substantially the same thickness. The easel may be formed as a unitary member and may comprise a plurality of primary feet arranged at each corner of the easel and a plurality of secondary feet arranged on a left side of the easel and a right side of the easel. At least one foot of the plurality of primary feet may be formed by a portion of the center front panel and a portion of the left front side panel, and at least one foot of the plurality of secondary feet may be formed by a portion of the left front side panel.

BRIEF DESCRIPTION OF THE DRAWINGS

Example embodiments of the disclosure will now be described by way of example only and with reference to the accompanying drawings, in which.

DETAILED DESCRIPTION

Figure 1A:
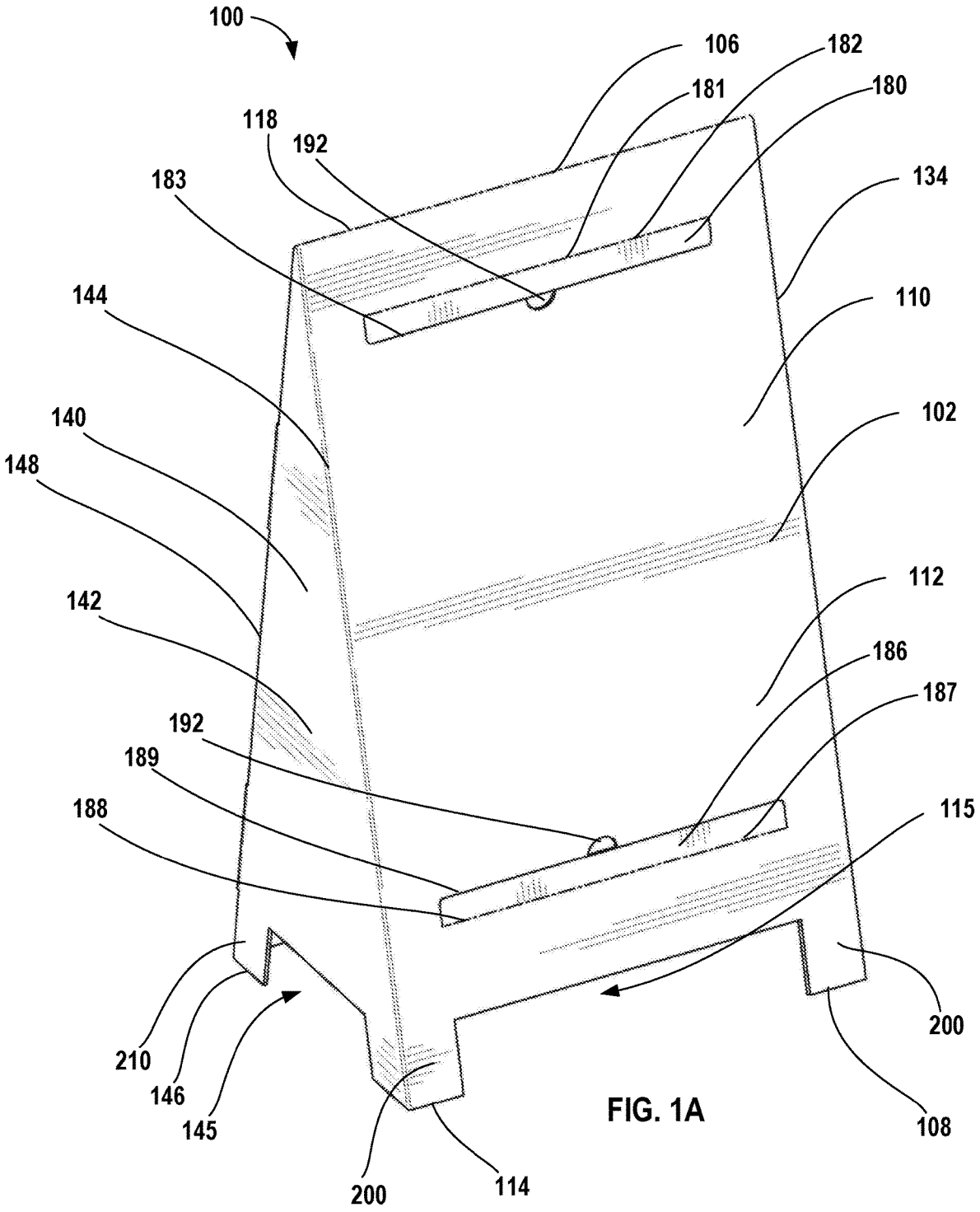
FIG. 1A illustrates a top, front, left perspective view of an example embodiment of an easel according to aspects disclosed herein.
Figure 1B:
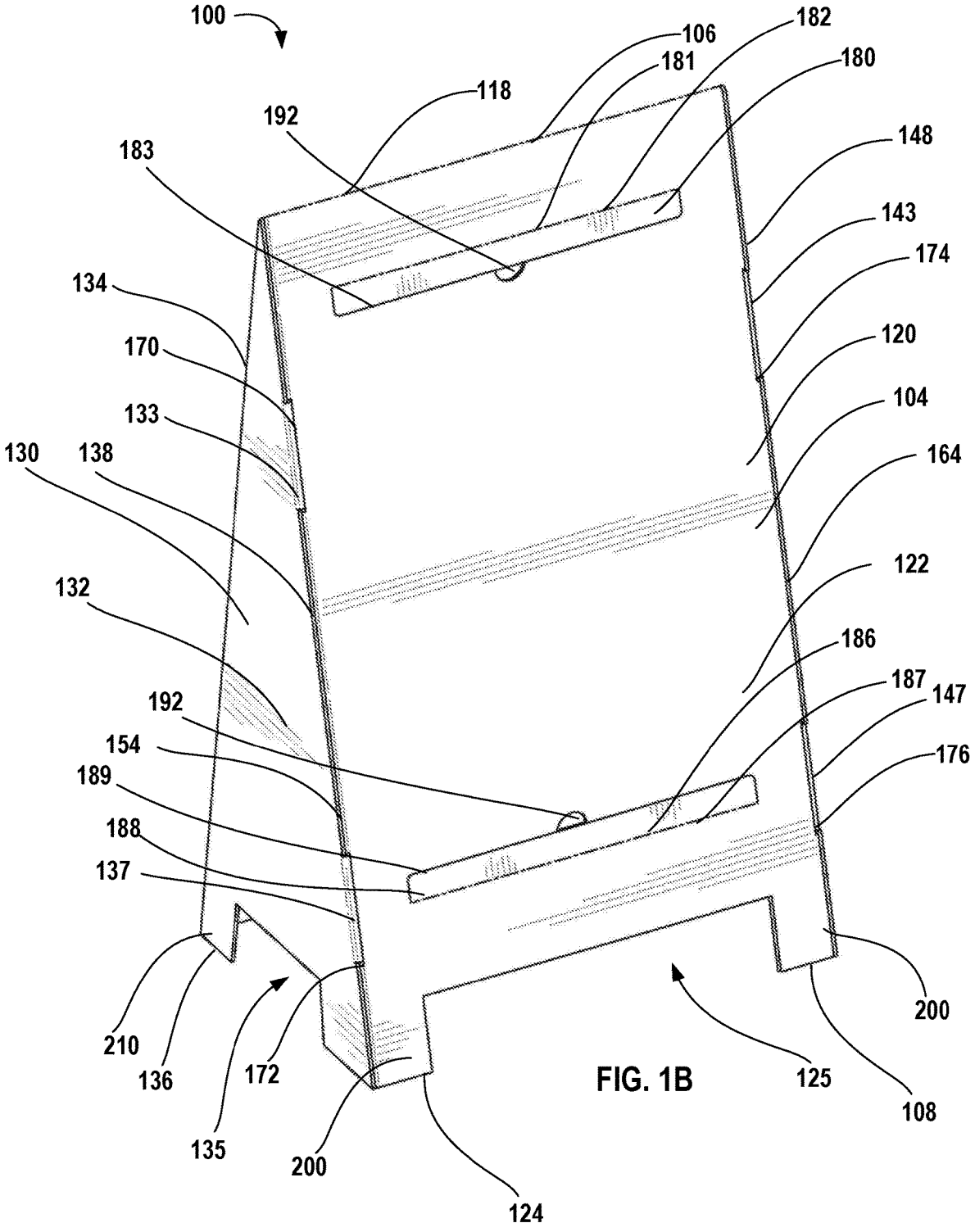
FIG. 1B illustrates a top, front, left perspective view of an example embodiment of the easel of FIG. 1A according to aspects disclosed herein.

In the following description of various examples of easels, portable easels, apparatuses, displays, signs, sign holders, and components thereof, of this disclosure, reference is made to the accompanying drawings, which form a part hereof, and in which are shown by way of illustration various example structures and environments in which aspects of the disclosure may be practiced.

It is to be understood that other structures and environments may be utilized and that structural and functional modifications may be made from the specifically described structures without departing from the scope of the present disclosure. However, those skilled in the art will readily appreciate that the disclosure herein is not limited to the scales, dimensions, proportions, and/or orientations shown in the figures. Also, while the terms "center", "top," "bottom," "front," "back," "left," "right," "side," "rear," and the like may be used in this specification to describe various example features and elements of the disclosure, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. The term "substantially parallel," as used herein, may indicate two surfaces that are oriented not more than 10 degrees of one another. Similarly, the term "substantially perpendicular," as used herein, may indicate two surfaces that are oriented not more than 10 degrees of being perpendicular (90 degrees) of one another. Nothing in this specification should be construed as requiring a specific three-dimensional orientation of structures in order to fall within the scope of this disclosure. The reader is advised that the attached drawings are not necessarily drawn to scale.

The embodiments described herein provide an apparatus for easels, portable easels, sign holders, portable sign holders, signs, or other advertising objects. In certain embodiments, the apparatus provides a portable, and in some cases disposable, easel that includes a means to secure a sign or panel that displays textual and/or visual information. In various other examples, the apparatus may be used to display information and/or keep erect other kinds of objects. These and other aspects, features and advantages of the disclosure, or of certain embodiments of the disclosure will be further understood by those skilled in the art from the following description of example embodiments.

In the exemplary embodiment shown in FIGS. 1A-6, the easel or sign holder 100 may have a front 102, a rear 104, a top 106, and a bottom 108 and comprise a center front panel 110, a center rear panel 120 adjacent a top edge of the center front panel 110, a left front side panel 140 adjacent the center front panel 110, a right front side panel 130 adjacent the center front panel 110 opposite the left front side panel 140, a right rear side panel 150 adjacent the center rear panel 120, a left rear side panel 160 adjacent the center rear panel 120 opposite the right rear side panel 150. The right front side panel 130 may have a pair of tabs 133, 137, and the left front side panel may also have a pair of tabs 143, 147. The easel 100 may also have a pair slots 170, 172 positioned between the center rear panel 120 and the right rear side panel 150, and also have a pair slots 174, 176 positioned between the center rear panel 120 and the left rear side panel 160. The center front panel 110 and the center rear panel 120 may further include flaps 180, 186 that are configured to removably secure a sign 10 or panel that displays text or other visual information. In addition, the easel 100 may be formed as a unitary, or single piece structure for ease of manufacturing, transport, storage, and setup.

In some embodiments, shown in FIGS. 1A-6, the easel 100 may have a presentation configuration or folded configuration, where the easel 100 forms an A-frame structure and the flaps 180, 186 secure a sign or panel 10. In the presentation configuration, the easel 100 may be folded along a fold line 118 positioned between the center front panel 110 and the center rear panel 120 such that the center front panel 110 and the center rear panel 120 form an acute angle 105 to each other. In some embodiments, angle 105 may be within a range of 15 degrees and 50 degrees. Additionally, the right rear side panel 150 may fold forward toward the center front panel 110 along fold line 154 and the right front side panel 130 may fold rearward along fold line 134 toward the center rear panel 120. The right front side panel 130 may lay adjacent and on the outside of the right rear side panel 150, such that the primary surface 132 of the right front side panel 130 may form an exterior side surface of the easel 100. The pair of tabs 133, 137 of the right front side panel 130 may comprise an upper tab 133 and a lower tab 137, whereas each tab 133, 137, may be folded inward along a fold line at the base of each tab 133, 137. The upper tab 133 may insert into an upper slot 170, and the lower tab 137 may insert into a lower slot 172. Similarly, the left rear side panel 160 may fold forward along fold line 164 toward the center front panel 110 and the left front side panel 140 may fold rearward along fold line 144 toward the center rear panel 120. The left front side panel 140 may lay adjacent and on the outside of the left rear side panel 160, such that the primary surface 142 of the right front side panel 140 may form an exterior side surface of the easel 100. The pair of tabs 143, 147 of the left side panel 140 may comprise an upper tab 143 and a lower tab 147, whereas each tab 143, 147, may be folded inward along a fold line along the base of each tab 143, 147. The upper tab 143 may insert into an upper slot 174, and the lower tab 147 may insert into a lower slot 176. The insertion of the tabs 133, 137, 143, 147 into the corresponding slots 170, 172, 174, 176 may provide a mechanical connection to allow the easel to form a self-supporting A-frame structure. Each tab 133, 137, 143, 147 may have a hook-like feature on its end to prevent each tab from inadvertently backing out of its corresponding slot when the easel is in the presentation configuration. While the exemplary embodiments illustrate a pair of tabs and slots on each side of the A-frame structure, in some embodiments, the tabs and slots may comprise a single tab, while in other embodiments, the tabs and slots may comprise a plurality of tabs where the number of tabs and corresponding slots may be 3, 4, 5, or more tabs. Still in other embodiments, the tabs 133, 137, 143, 147 may be attached to the rear center panel 120 by a mechanical connection such as a mechanical fasteners, (i.e. screw, rivets, etc.), hook and loop type fastener, or tape, or adhesives, or may be inserted into an opening formed on the rear center panel 120. In the presentation configuration, the side panels 130, 140, 150, 160 may extend fully from the center front panel 110 to the center rear panel 120, or may extend only a portion of a distance between the center front panel 110 and the center rear panel 120.

Figure 7:
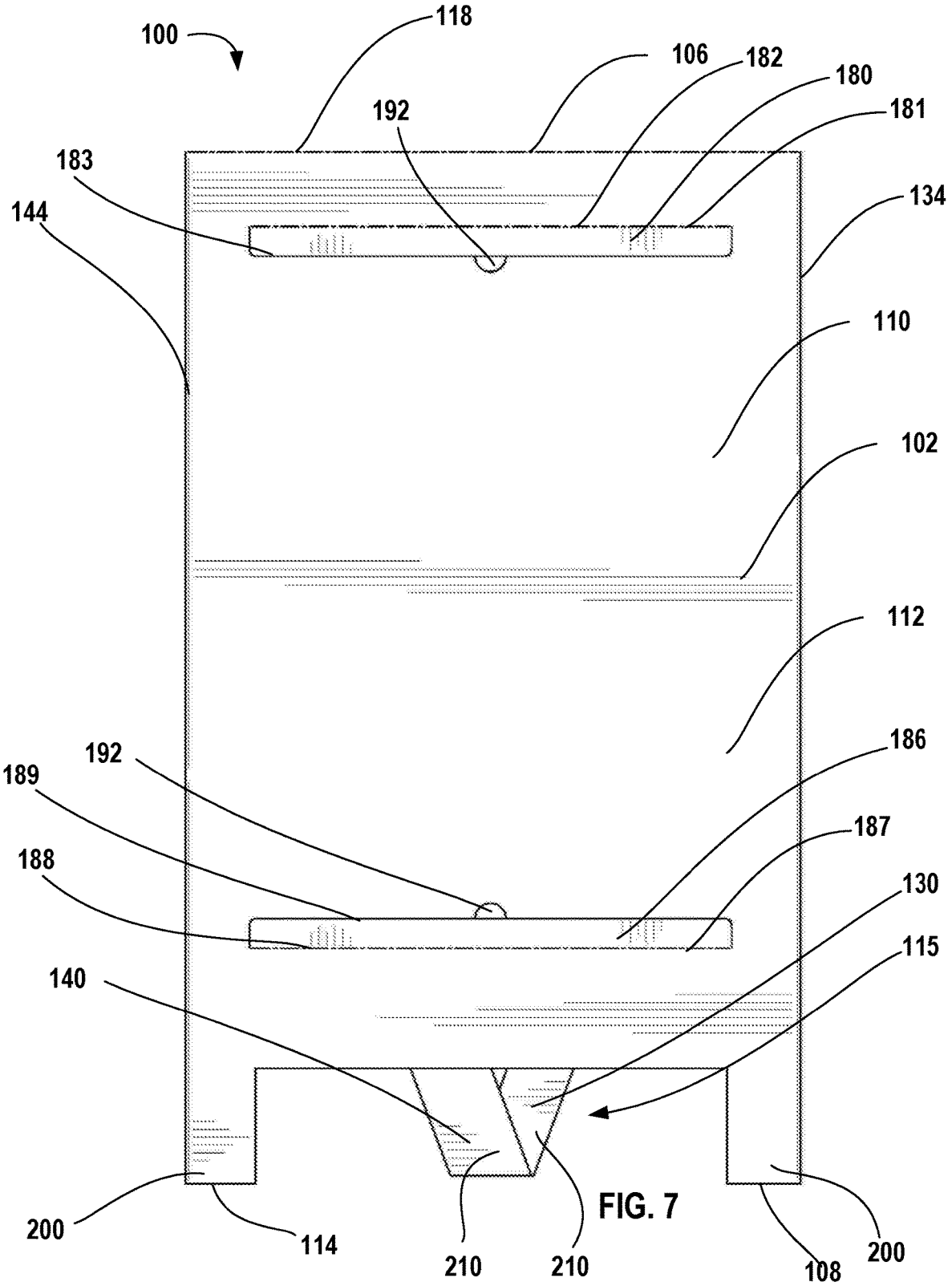
FIG. 7 illustrates a front view of an alternate embodiment of the easel of FIG. 1A according to aspects disclosed herein.
Figure 8:
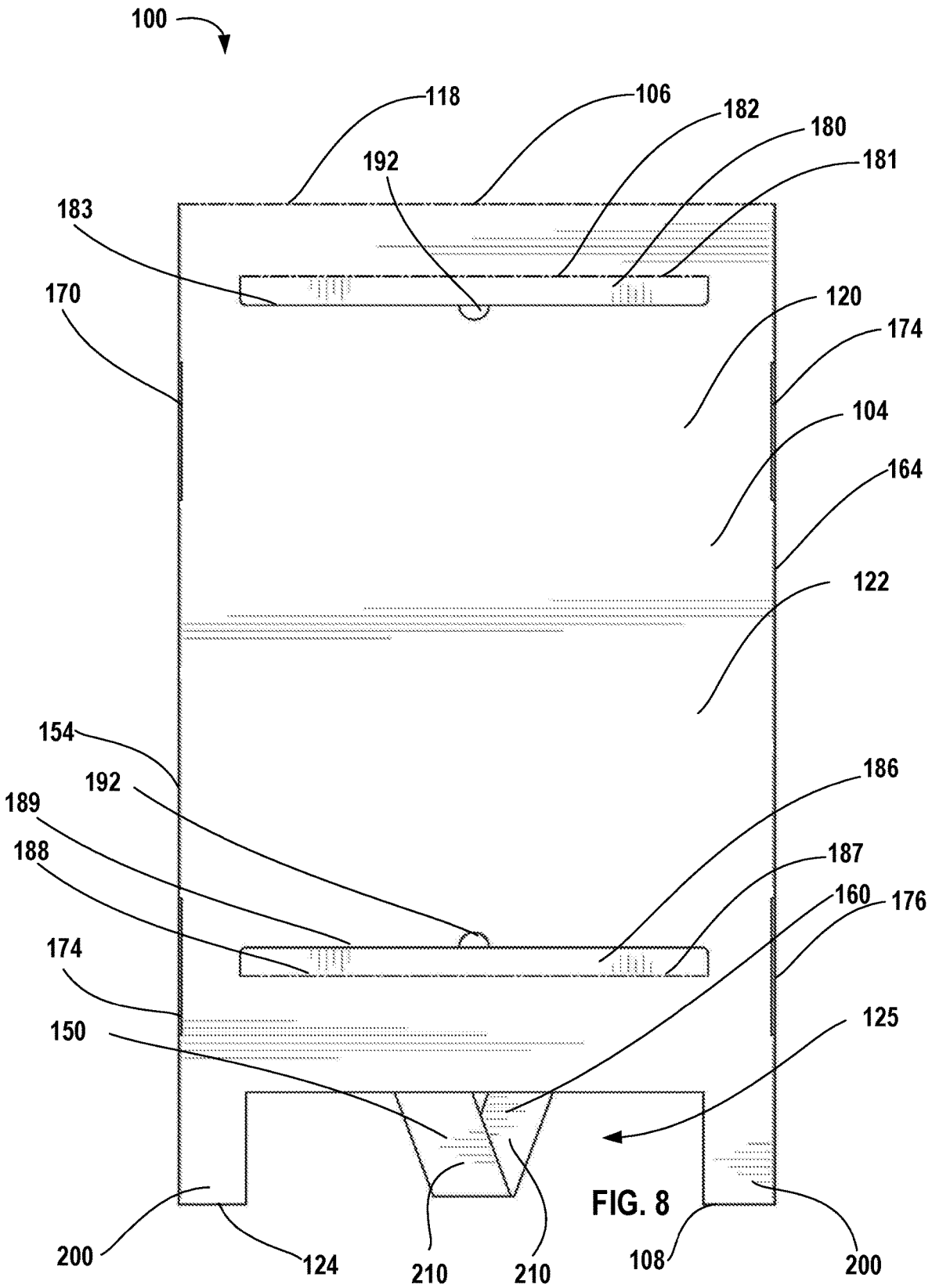
FIG. 8 illustrates a rear view of an alternate embodiment of the easel of FIG. 7 according to aspects disclosed herein.
Figure 9:
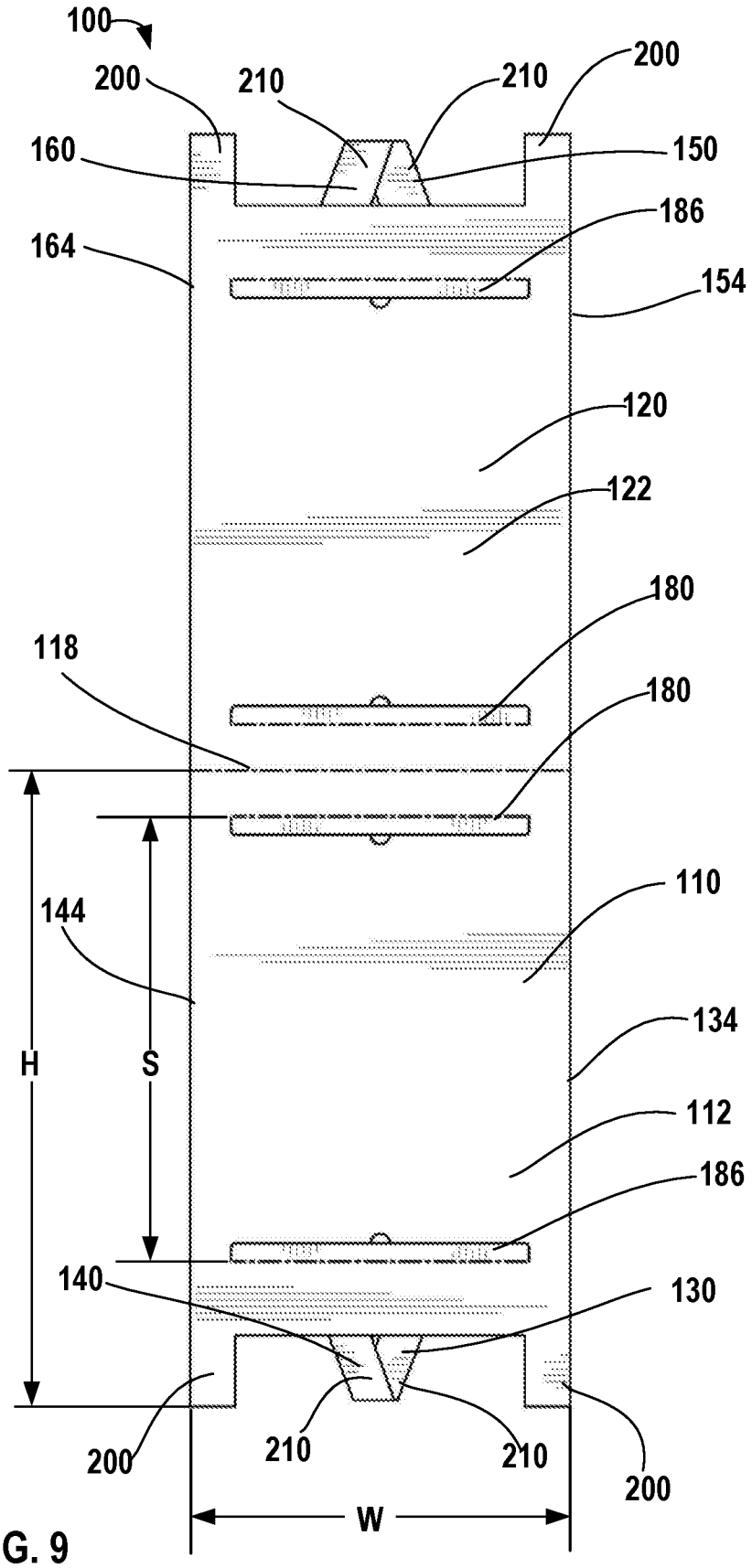
FIG. 9 illustrates a front view of an alternate embodiment of the easel of FIG. 1A according to aspects disclosed herein.
Figure 10:
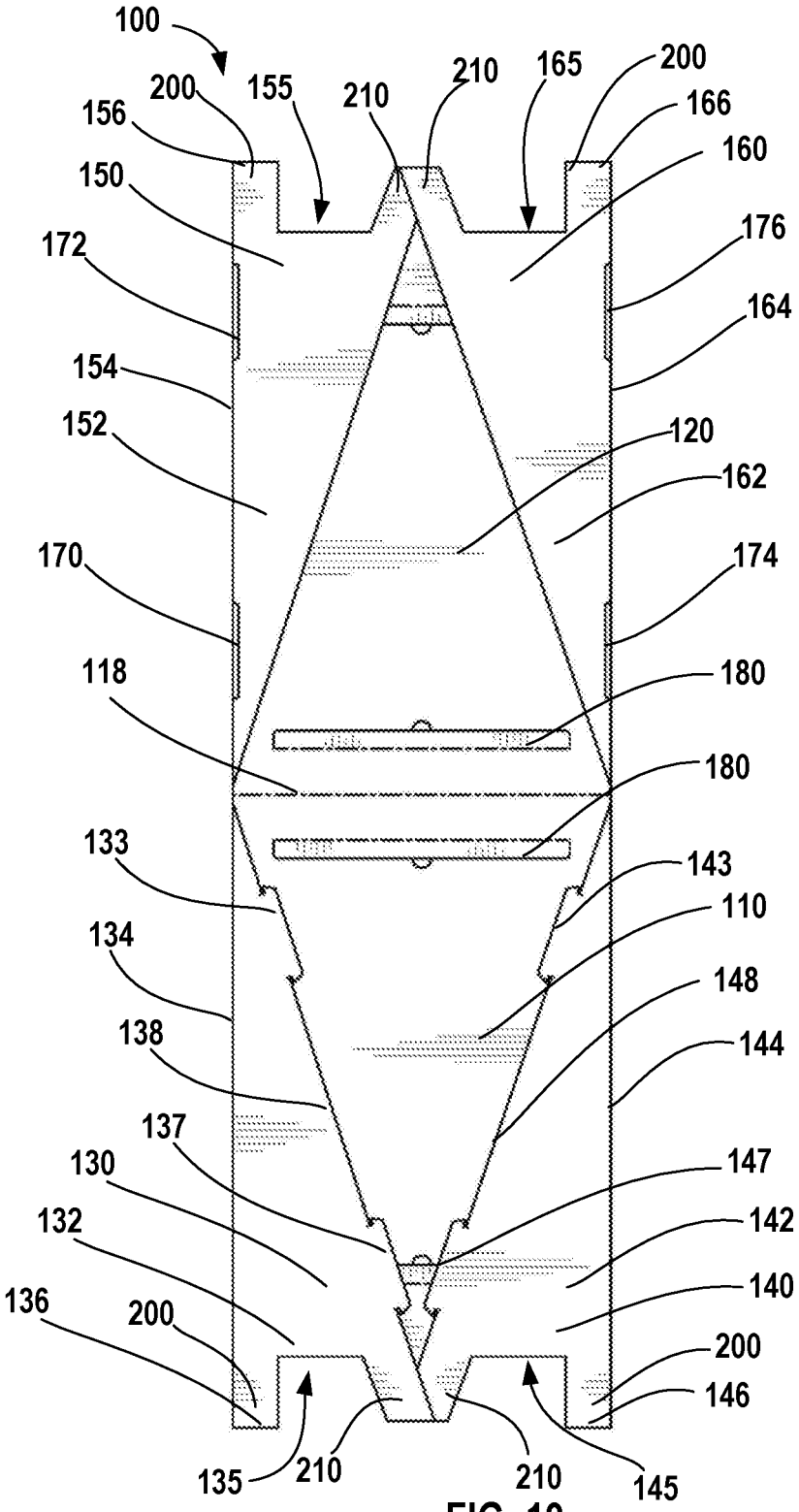
FIG. 10 illustrates a rear view of an alternate embodiment of the easel of FIG. 9 according to aspects disclosed herein.
Figure 11:
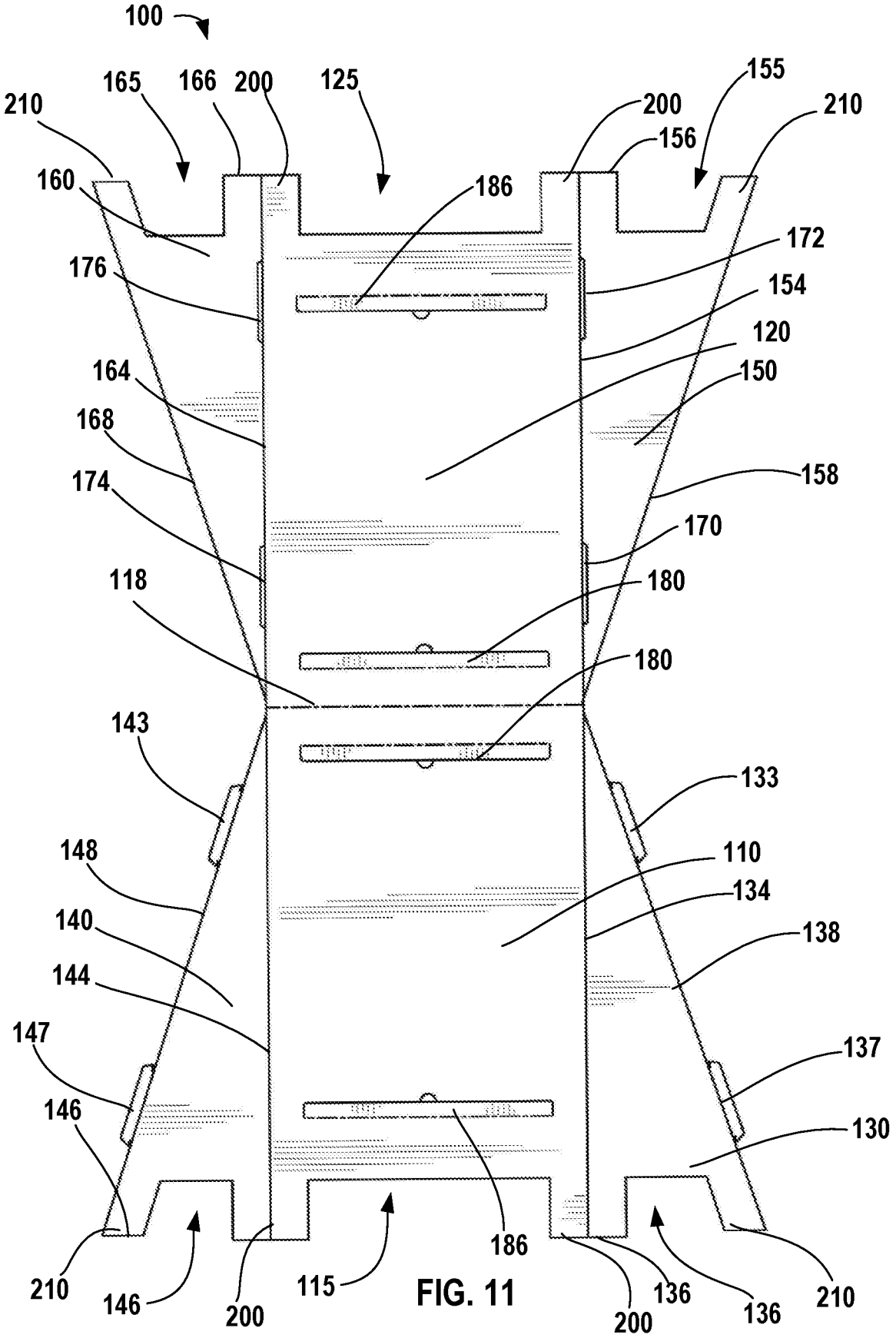
FIG. 11 illustrates a front view of an alternate embodiment of the easel of FIG. 1A according to aspects disclosed herein.
Figure 12:
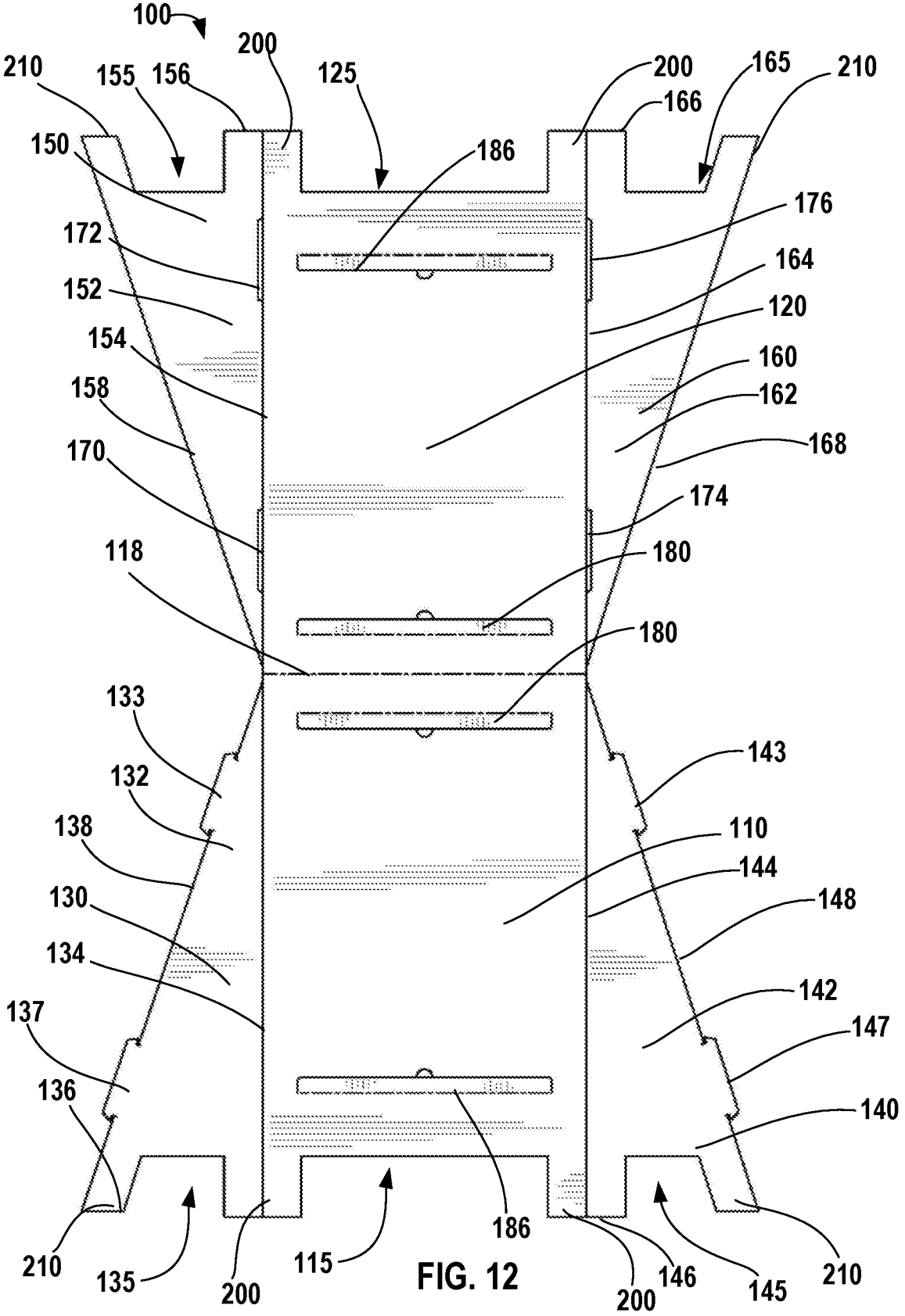
FIG. 12 illustrates a rear view of an alternate embodiment of the easel of FIG. 11 according to aspects disclosed herein.
Figure 13:
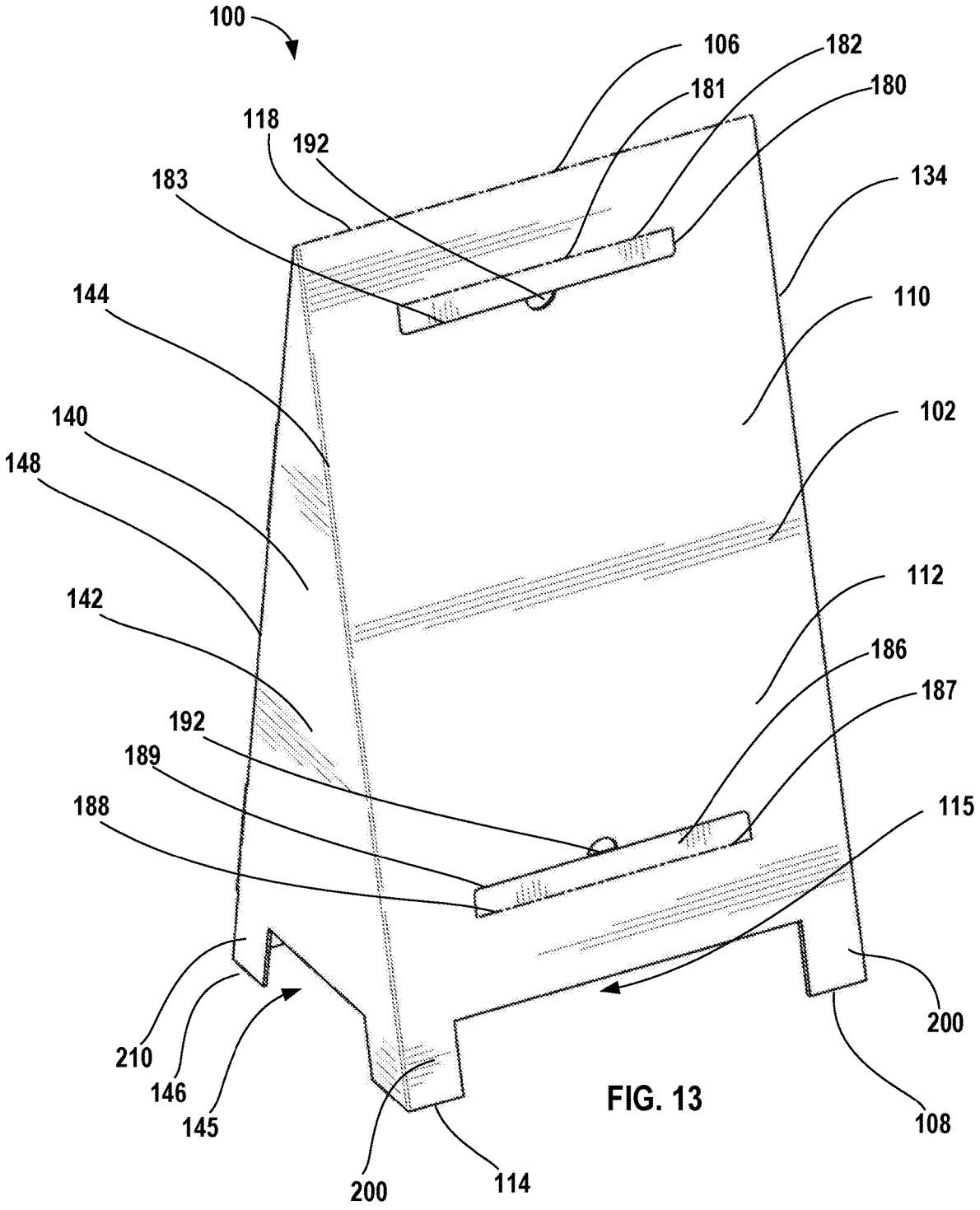
FIG. 13 illustrates a top, front, left perspective view of an alternate example embodiment of an easel of FIG. 1A according to aspects disclosed herein.
Figure 14:
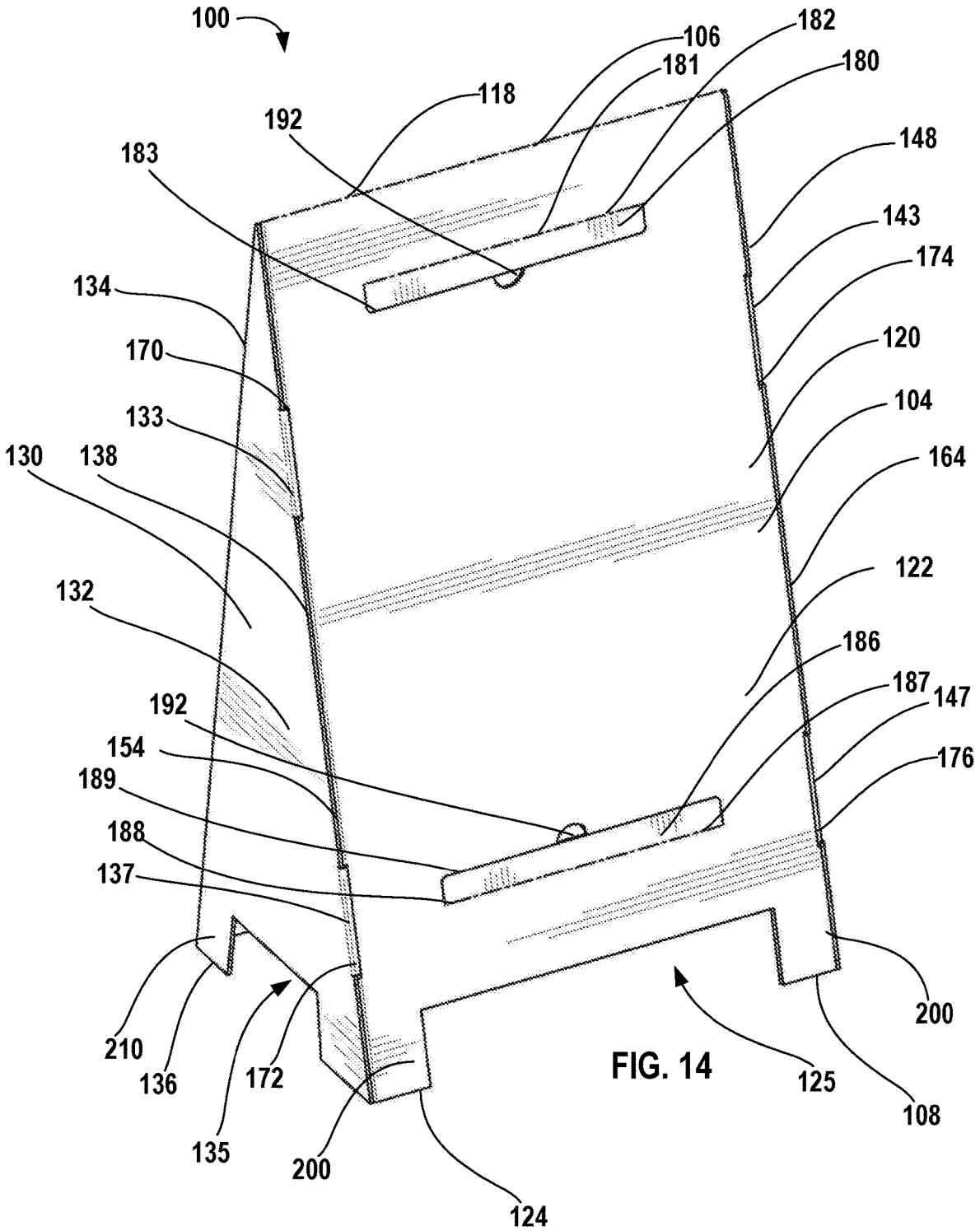
FIG. 14 illustrates a top, rear, right perspective view of an example embodiment of the easel of FIG. 13 according to aspects disclosed herein.
Figure 15:
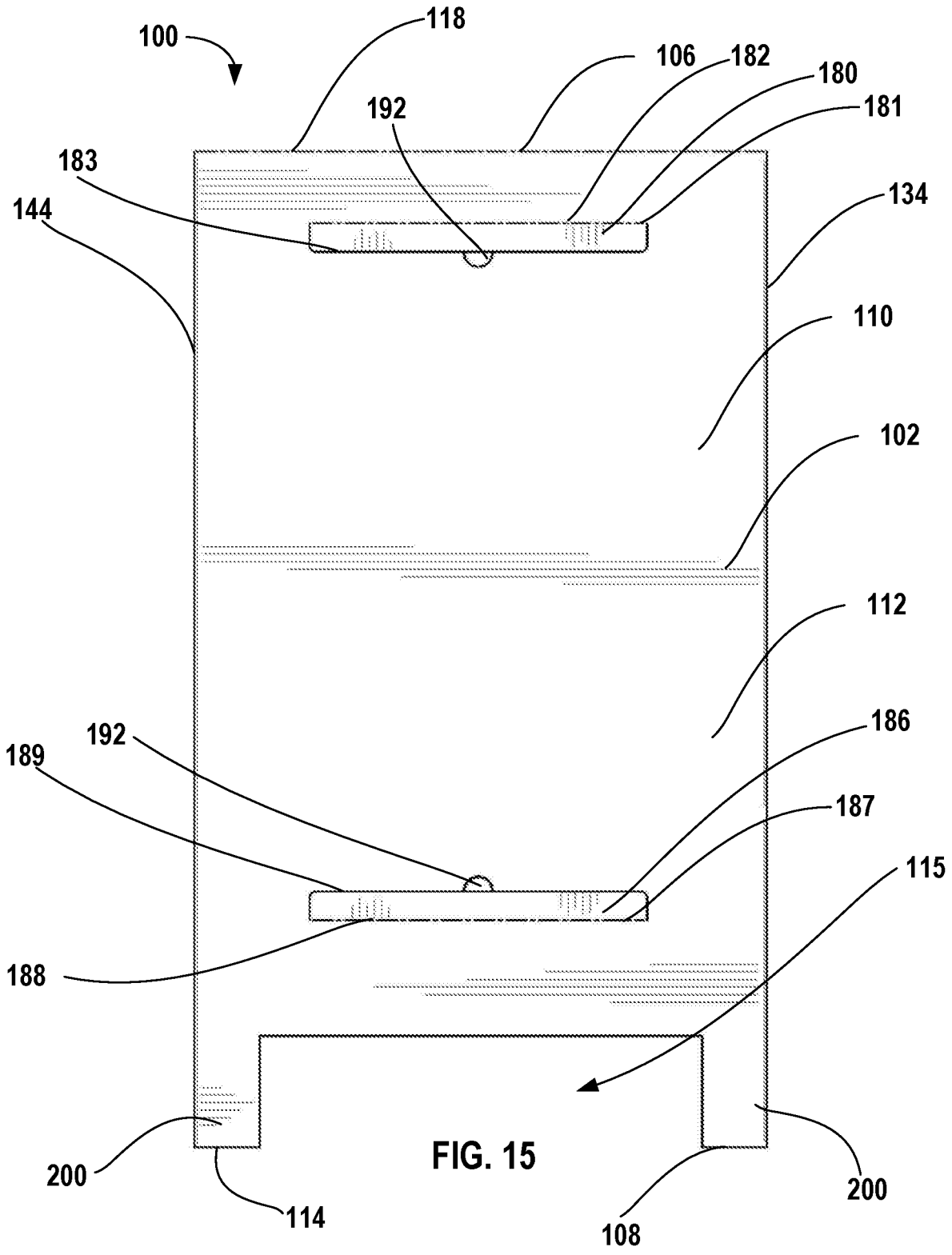
FIG. 15 illustrates a front side view of an example embodiment of the easel of FIG. 13 according to aspects disclosed herein.
Figure 16:
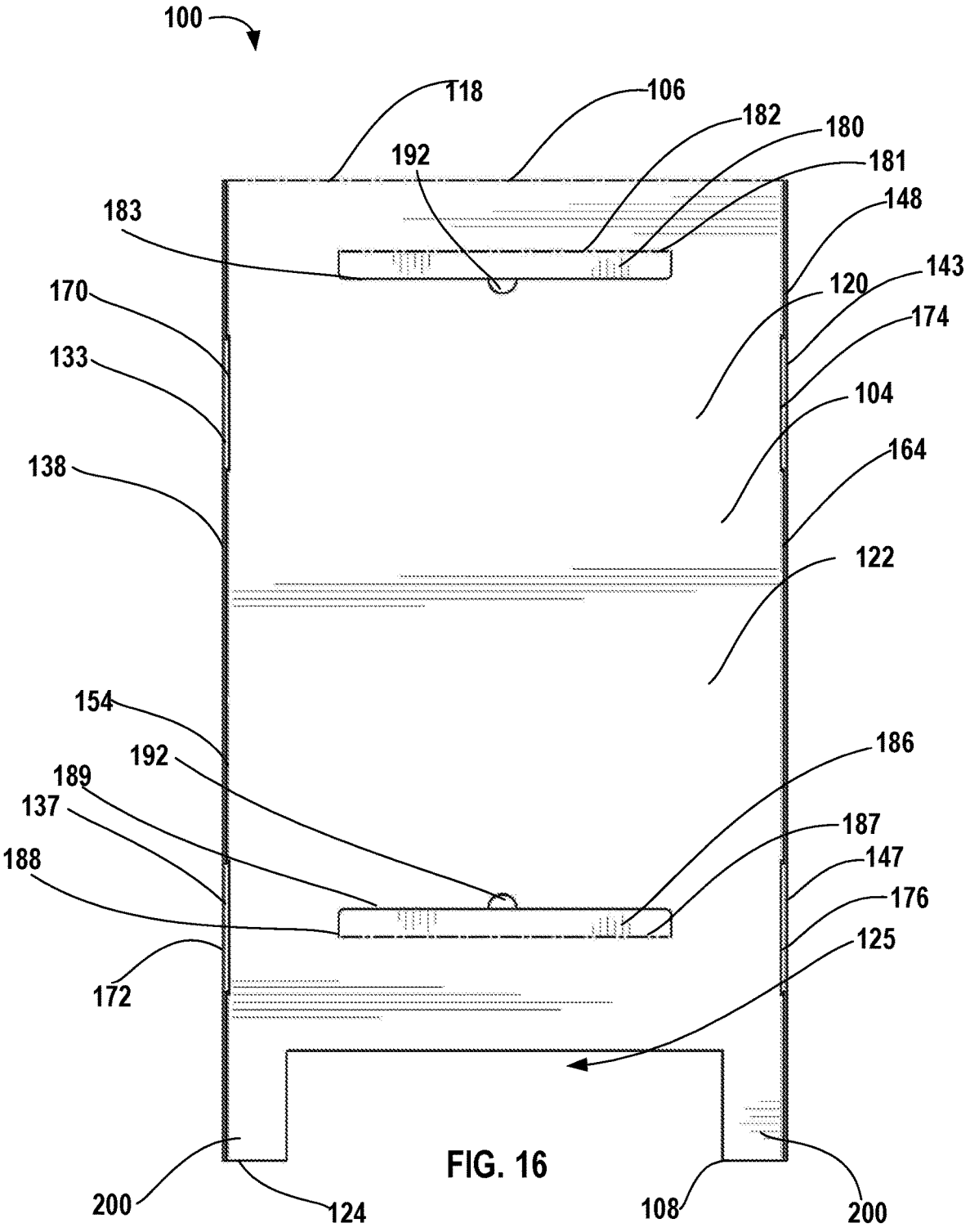
FIG. 16 illustrates a rear side view of an example embodiment of the easel of FIG. 13 according to aspects disclosed herein.
Figure 17:
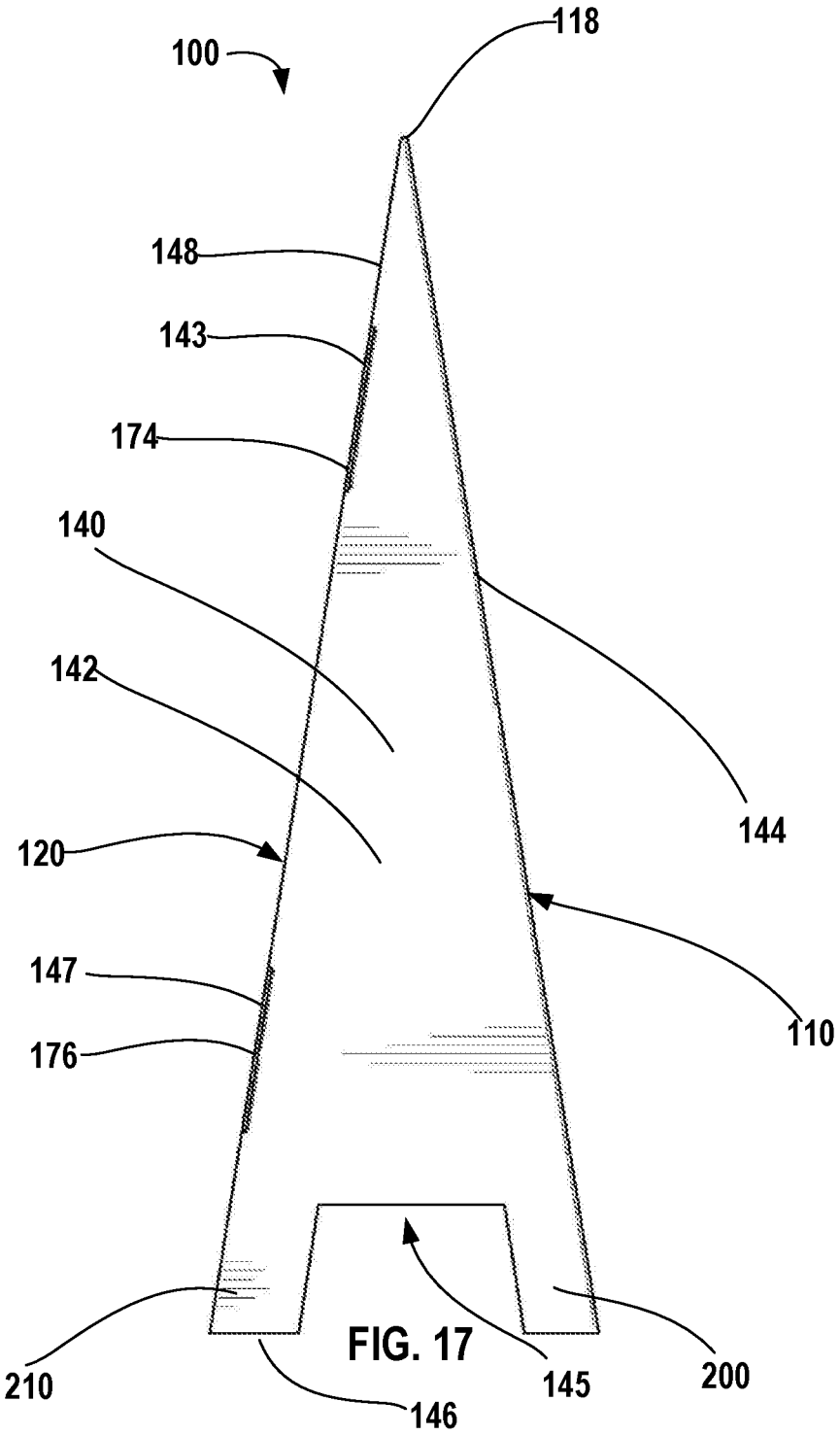
FIG. 17 illustrates a right side view of an example embodiment of the easel of FIG. 13 according to aspects disclosed herein.
Figure 18:
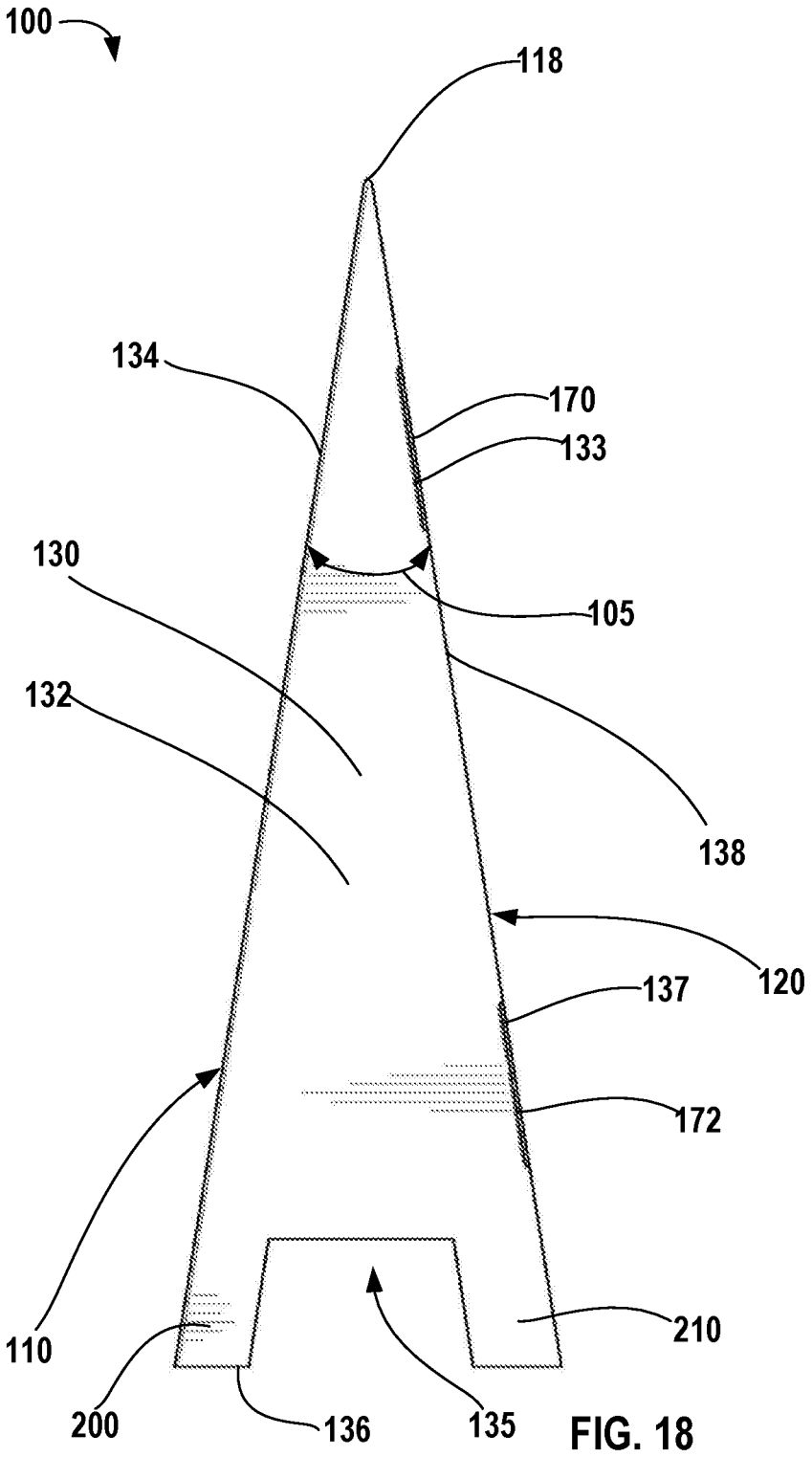
FIG. 18 illustrates a left side view of an example embodiment of the easel of FIG. 13 according to aspects disclosed herein.
Figure 19:
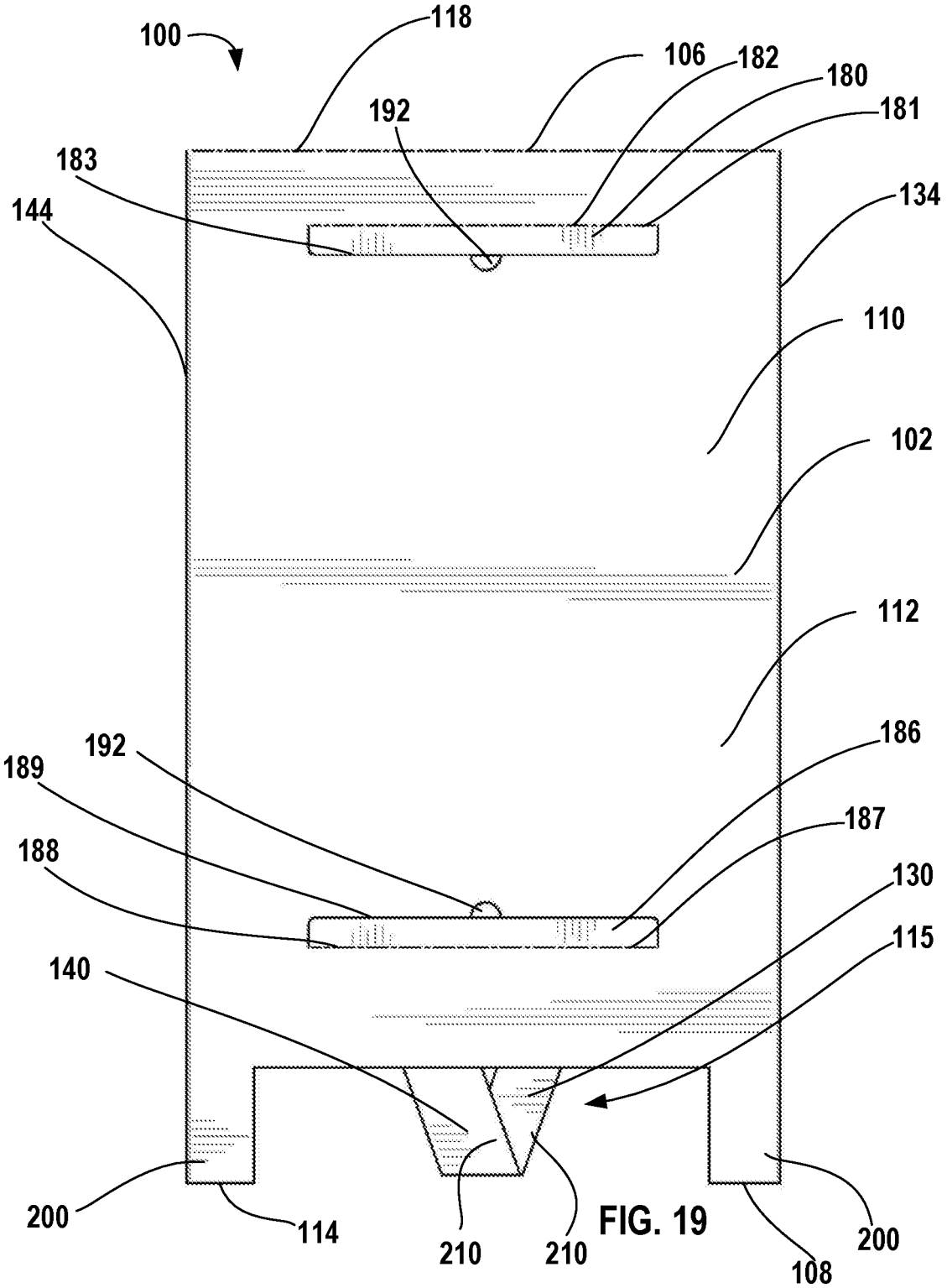
FIG. 19 illustrates a front view of an alternate embodiment of the easel of FIG. 13 according to aspects disclosed herein.
Figure 20:
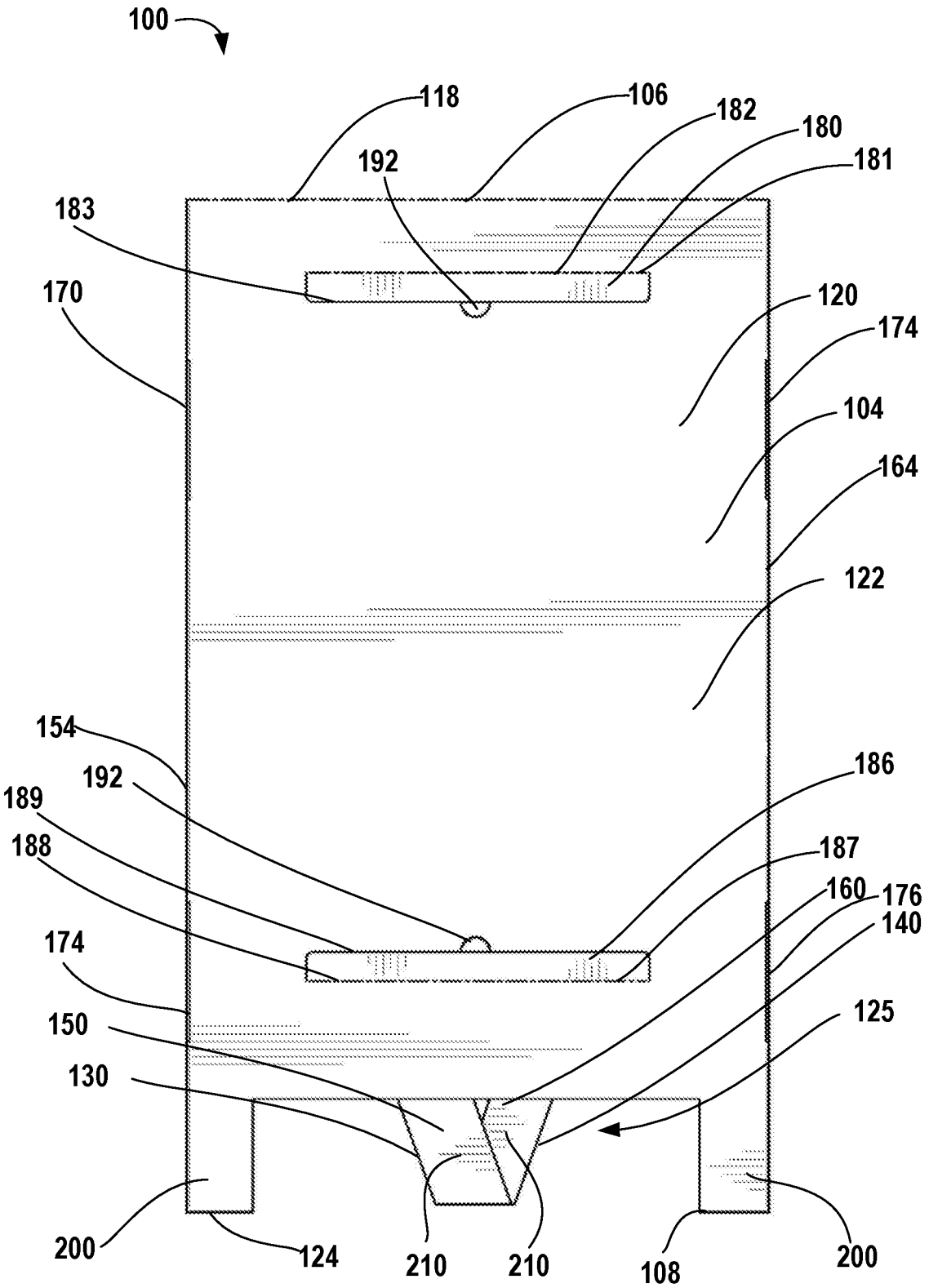
FIG. 20 illustrates a rear view of an alternate embodiment of the easel of FIG. 19 according to aspects disclosed herein.

In other embodiments, the easel 100 may have storage or unfolded configurations, as shown in FIGS. 7-12. In these storage configurations, the center front panel 110 and the center rear panel 120 may be arranged substantially parallel to each other. These unfolded configurations may be used to easily transport or store the easel 100. These unfolded configurations may comprise a configuration as shown in FIGS. 7 and 8, where the center front panel 110 is folded along fold line 118 onto the center rear panel 120 such that the center front panel 110 is substantially parallel to the center rear panel 120. The right side panels 130, 140, and left side panels 150, 160 may fold inward such that the front profile of the easel 100 is no larger than the size or area of the center front panel 110. This configuration may give the easel 100 a slim profile to be easily stored, stacked, or transported. FIGS. 9-10 illustrate another unfolded configuration, where the easel 100 is laid flat such that the center front panel 110 and center rear panel 120 are oriented substantially parallel to each other such that the center panels 110, 120 form a substantially planar surface. Similar to the unfolded configuration of FIGS. 7-8, the right side panels 130, 140, and left side panels 150, 160 may fold inward such that the front profile of the sign is no larger than the combined size or area of the center front panel 110 and the center rear panel 120. FIGS. 11-12 illustrate another unfolded configuration, where the easel 100 is flat with the center panels 110, 120 and side panels 130, 140, 150, and 160 are all parallel with each other and such that all the panels form a substantially planar surface.

The center panels 110, 120 may be generally rectangularly shaped extending along the primary surfaces 112, 122 from bottom edges 114, 124 respectively to a fold line 118, between the center front panel 110 and the center rear panel 120. The center front panel 110 may extend horizontally along the primary surface 112 from a left front fold line 144 to a right front fold line 134. Similarly, the center rear panel 120 may extend horizontally along the primary surface 122 from a left rear fold line 164 to a right rear fold line 154. The left fold line 144, 164 and may be parallel to the right fold lines 134, 154. The left and right side panels 130, 140, 150, 160 may have a generally triangular shape. Each of the left and right side panels 130, 140, 150, 160 may have a primary surface 132, 142, 152, 162 that extends from a fixed end along each side panel's respective fold line 134, 144, 154, 164 to a free end 138, 148, 158, 168 respectively. The fold line 134, 144, 154, 164 of each side panel 130, 140, 150, 160 may converge toward its respective free end 138, 148, 158, 168 as it approaches fold line 118. In some embodiments, the fold line 134, 144, 154, 164 may intersect or connect to its respective free end 138, 148, 158, 168 at fold line 118. In addition, each fold line 134, 144, 154, 164 of each side panel 130, 140, 150, 160 may extend from each side panel's bottom edge 136, 146, 156, 166 to the fold line 118 along the top end 106 of the easel 100. Accordingly, the side panels 130, 140, 150, 160 may have a width that is greater at the bottom end than at the top end.

Additionally, the easel 100 may be supported by a plurality of primary feet 200 positioned at the corners of the easel 100 along the bottom end 108 of the easel 100 as well as secondary feet 210 positioned along the left and right sides of the easel 100 along the bottom end 108. The primary feet 200 may comprise a support structure formed from a portion of the center panels 110, 120 and a portion of one of its adjacent side panels 130, 140, 150, 160, where each primary foot 200 is formed by at least two substantially perpendicular surfaces when the easel 100 is in the presentation configuration along the bottom end 108. The secondary feet 210 may be located on the side panels 130, 140, 150, 160 and include a single planar surface. The feet 200, 210 may be formed by central cutouts or openings 115, 125, 135, 145, 155, 165 positioned along the bottom edges of the center panels 110, 120 and side panels 130, 140, 150, 160. The lower central openings 115, 125, 135, 145, 155, 165 may be any geometric shape such as, but not limited to, rectangular shaped, rounded shape, or trapezoidal shaped. The central openings 115, 125, 135, 145, 155, 165 may also provide a pathway for air to flow through the easel 100 to make it more resistant to wind forces.

As discussed above, the center front panel 110 and the center rear panel 120 may be configured to secure a sign 10. A sign 10 may be secured onto the center front panel 110 and also may be secured onto the center rear panel 120. On the center panels 110, 120, a sign 10 may be secured at an upper end 12 by upper flap 180 and at a lower end 14 by lower flap 186. Each flap 180, 186 may be substantially rectangularly shaped and extend across a majority of the primary surface 112, 122 of the center panels 110, 120. Each upper flap 180 may be oriented substantially parallel to each lower flap 186. The upper flap 180 may have a fixed end 181 along a fold line 182 and a free end 183 positioned beneath the fixed end 181 such that the free end 183 rotates outward with an opening oriented towards a center of the center panels 110, 120. The lower flap 186 may have a fixed end 187 along a fold line 188 and a free end 189 positioned above the fixed end 187 such that the free end 189 rotates outward with an opening oriented towards a center of the center panels 110, 120. The interior surface of the upper flap 180 may contact the exposed surface of the sign 10 to secure the upper end of the sign 10. Similarly, the interior surface of the lower flap 186 may contact the exposed surface of the sign 10 to secure the upper end of the sign 10. Each upper flap 180 may be spaced a predetermined distance from the lower flap 186 to accommodate a predetermined sized sign 10. For instance, the predetermined distance, S, of the upper flap 180 to the lower flap 186 when measured from the fold line 182 of the upper flap 180 to the fold line 188 of the lower flap 186 may be approximately 25 inches or may be spaced within a range of 12 inches and 32 inches, or may be spaced within a range of 10 inches and 38 inches, or may be spaced within a range of 3 inches to 60 inches. In some embodiments, the predetermined distance, S, of the upper flap 180 to the lower flap 186 may be expressed as a percentage of an overall height, H, of the center panels 110, 120, where the overall height is measured from a bottom edge 114, 124 of the center panels to the fold line 118. For example, the spacing, S, between the upper flap 180 and the lower flap 186 may be approximately 70 percent of the overall height, H, of the center panels, 110, 120, or the spacing, S, may be within a range between 55 percent and 85 percent of the overall height, H. The spacing, S, of the flaps 180, 186 may be the same on the center front panel 110 as the center rear panel 120, or in some instances the spacing, S, of the flaps 180, 186 may be different on the center front panel 110 than the center rear panel 120. While not limiting, the overall height, H, of the center panels 110, 120 in some embodiments may be within a range of 12 inches to 48 inches, or in other embodiments may be within a range of 6 inches to 72 inches. Additionally, a center point of the spacing between the upper flap 180 and the lower flap 186 may be above a center point of the center panels 110, 120, such that the distance from the fold line 182 of upper flap 180 to the fold line 118 is less than the distance of the fold line 188 of the lower flap 186 from the bottom edges 114, 124 of the center panels 110, 120.

As discussed above, each flap 180, 186 may extend across a majority of the primary surface 112, 122 of the center panels 110, 120. For example, flaps 180, 186 may have a width of approximately 75 percent of an overall width of the center panels 110, 120, or have a width within a range of 60 percent and 85 percent of an overall width of the center panels 110, 120, or have a width within a range of 55 percent and 90 percent of an overall width of the center front panel 110. The center panels 110, 120 may have a width, W, within a range of 12 inches and 28 inches, or within a range 4 inches to 48 inches. The flaps 180, 186 may each have the same width, or in some instances may have different widths. As shown in the illustrated embodiments, each flap 180, 186 may be centered along the overall width of the center panels 110, 120, while in other embodiments, each flap 180, 186 may be biased to either the left or the right side of the overall width of the center panels 110, 120. Each flap 180, 186 may have a height defined as the distance from the fold line 182, 188 to the free end 183, 189 of approximately one inch or within a range of 0.5 inches to 2 inches. The flaps 180, 186 may each have the same height, or in some instances may have different heights. As another option, the center panels 110, 120 may have a centrally located aperture 192 adjacent the free ends 183, 189 of the flaps 180, 186. Aperture 192 may have a diameter or width of less than 2 inches and may enable a user to grasp and fold the flaps 180, 186 outward easier.

As discussed above, the easel 100 may have different sizes. As illustrated in FIGS. 13-20, the easel 100 may also be sized to have different ratios of width to height to accommodate a variety of sized signs 10. The easel 100 may have a ratio of width, W, to height, H, within a range of 0.50:1 and 0.75:1.

As previously discussed, the insertion of the tabs 133, 137, 143, 147 into the corresponding slots 170, 172, 174, 176 may provide a mechanical connection to allow the easel to form a self-supporting A-frame structure. Tabs 133, 137 may extend from the free end 138 of the right side panel 130, while tabs 143, 147 may extend from the free end 148 of the left side panel 140. The tabs 133, 137 may be spaced apart from each other along the free end 138 such that the upper tab 133 may be positioned above the centerline of the side panel 130, and the lower tab 137 may be positioned below the centerline of the side panel 130. Similarly, the upper tab 143 may be positioned above the centerline of the side panel 140, and the lower tab 147 may be positioned below the centerline of the side panel 140. Each tab 133, 137, 143, 147 may have a tapered portion opposite the base for ease of installation.

Each slot 170, 172, 174, 176 may be arranged to receive one of the tabs 133, 137, 143, 147. Each slot 170, 172, 174, 176 may be generally rectangular in shape with a height that is greater than the width. In addition, the height of each slot 170, 172, 174, 176 may be less than a height of each tab 133, 137, 143, 147, such that once the each tab in inserted into its corresponding slot, the tab may have a mechanical connection to keep them securely engaged. For example, each tab 133, 137, 143, 147 may have a height greater than the height of its corresponding slot 170, 172, 174, 176. For ease of installation in this example, each tab may be inserted into its corresponding slot at an angle.

The easel 100 may be preferably formed as a single unitary member such that it may be easily stored and transported. In some embodiments, the easel 100 may be formed from a cellulose fiber material such as cardboard, which may consist of a single or of multiple layers. The cardboard may have a corrugated interior layer sandwiched between layers of paper or may be non-corrugated. In addition, the easel 100 may be formed from a polymer material, such as a corrugated or non-corrugated polymer using materials such as polypropylene, polycarbonate, or similar materials known to one skilled in the art. The easel 100 may be formed from a single sheet of material and cut to the desired shape using any appropriate method known to one skilled in the art.

The fold lines as referenced herein may be formed from any methods known to one skilled in the art, such as a compressed region, where the layers along the fold line are compressed to promote a user to easily fold the panels along the fold line, or a perforated region where multiple intermittent cuts or openings are formed along the fold line to promote folding. These perforated regions may be partially through the thickness of the easel 100 or entirely through the thickness of the easel depending on the embodiment. Some fold lines may be a combination of a compressed region and a perforated region. In addition, with the exception of the fold lines regions, the easel 100 may have a constant wall thickness, where the wall thickness of each panel 110, 120, 130, 140, 150, 160 is the same thickness. For instance, the wall thickness of each panel may be approximately 0.125 inches or within a range of 0.09 inches and 0.250 inches, or within a range of 0.06 inches and 0.375 inches.

The sign or panel 10 may be removably secured to the easel 100. The sign 10 may be any suitable material for displaying information, including textual and/or graphic and/or advertising information, or other visual material. In some examples, the sign 10 may comprise a paper, metal, plastic, corrugated plastic, or other material suitable to display information. In certain examples, some or all of the sign 10 may comprise a weather and/or water and/or sun resistant material, such that it may efficiently convey visual information even after prolonged, accumulated exposure to the elements.

Figure 2A:
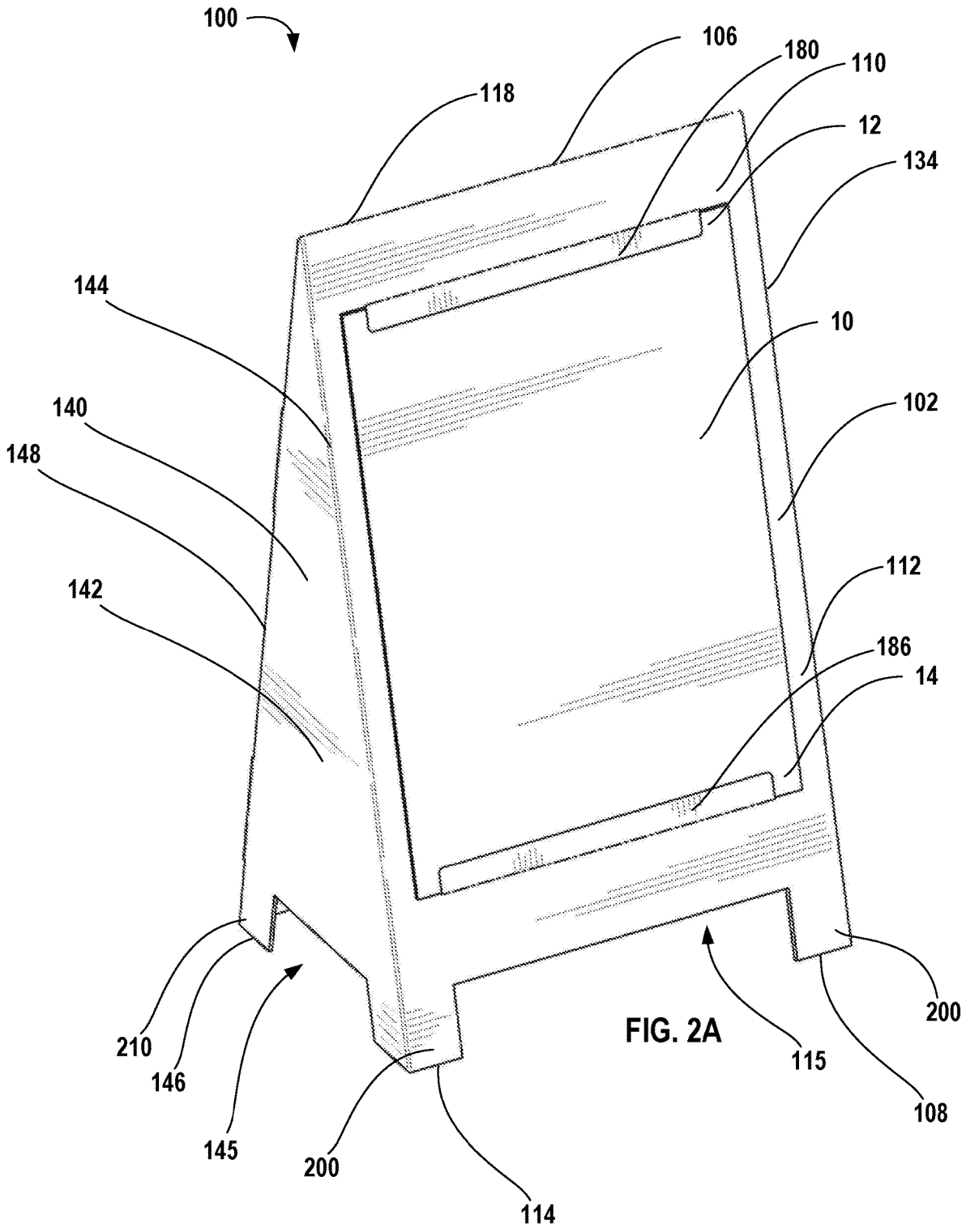
FIG. 2A illustrates top, front, left perspective view of an example embodiment of the easel of FIG. 1A with a sign secured in the easel according to aspects disclosed herein.
Figure 2B:
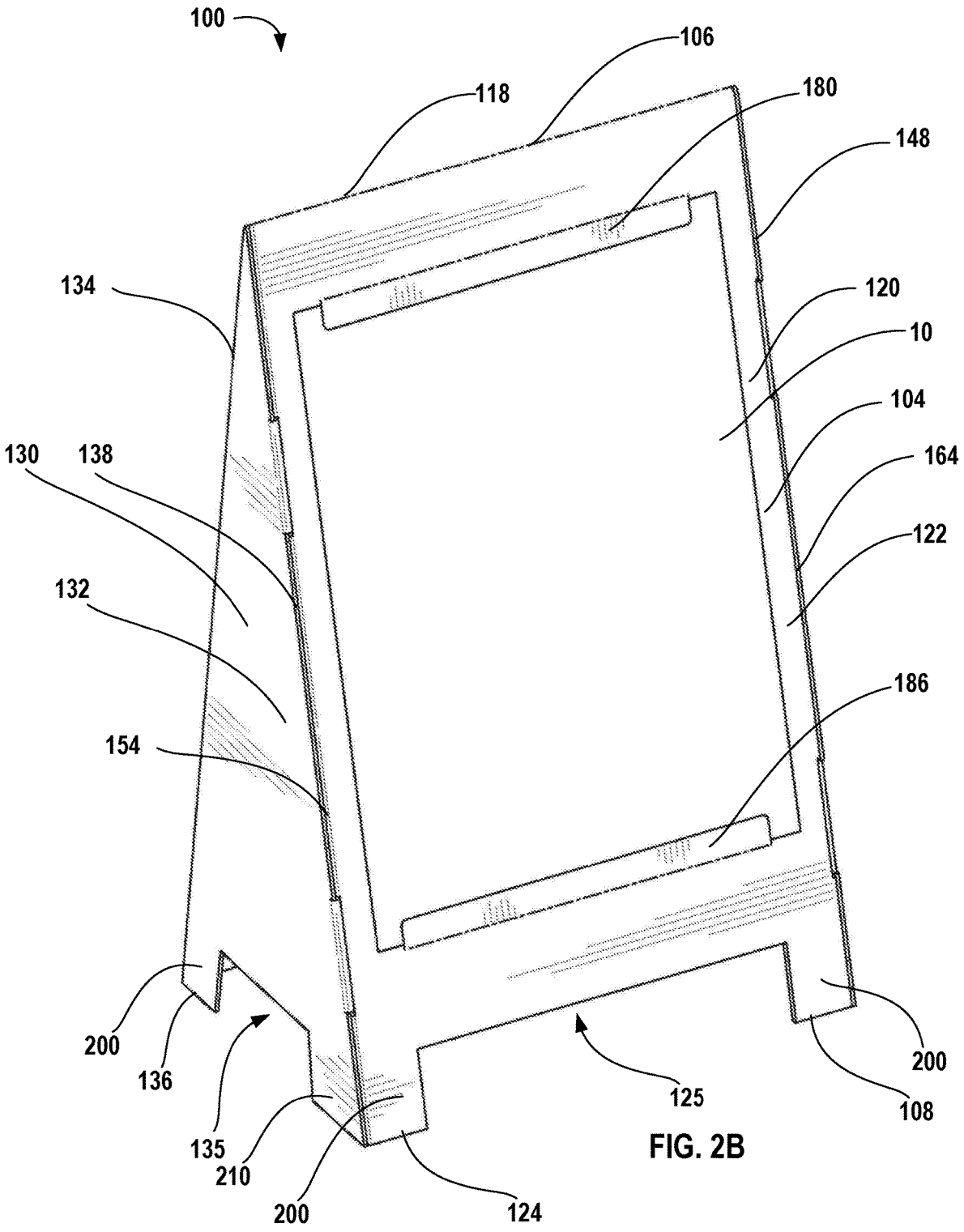
FIG. 2B illustrates a top, front, left perspective view of an example embodiment of the easel of FIG. 1A with a sign secured in the easel according to aspects disclosed herein.
Figure 3:
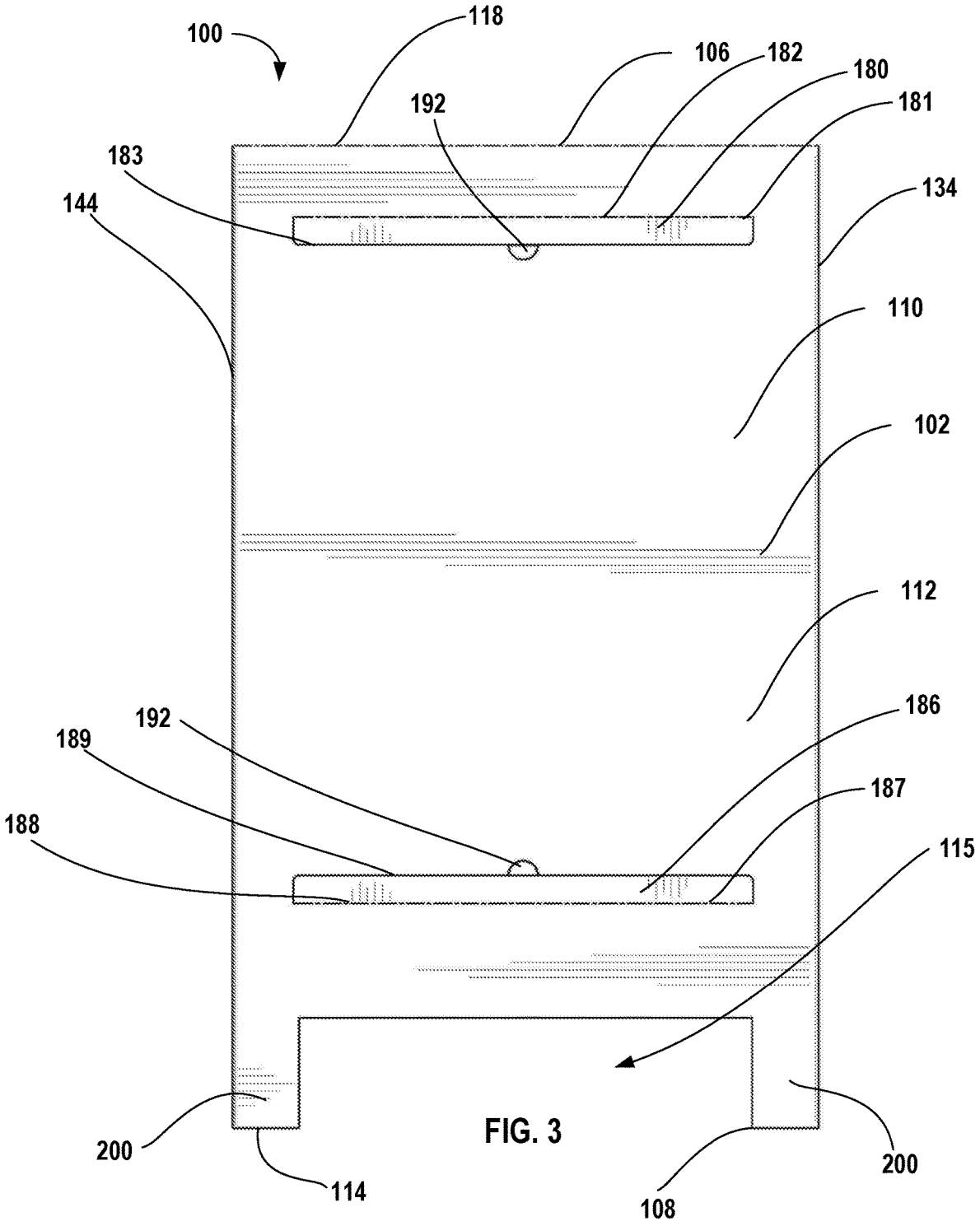
FIG. 3 illustrates a front view of an example embodiment of the easel of FIG. 1A according to aspects disclosed herein.
Figure 4:
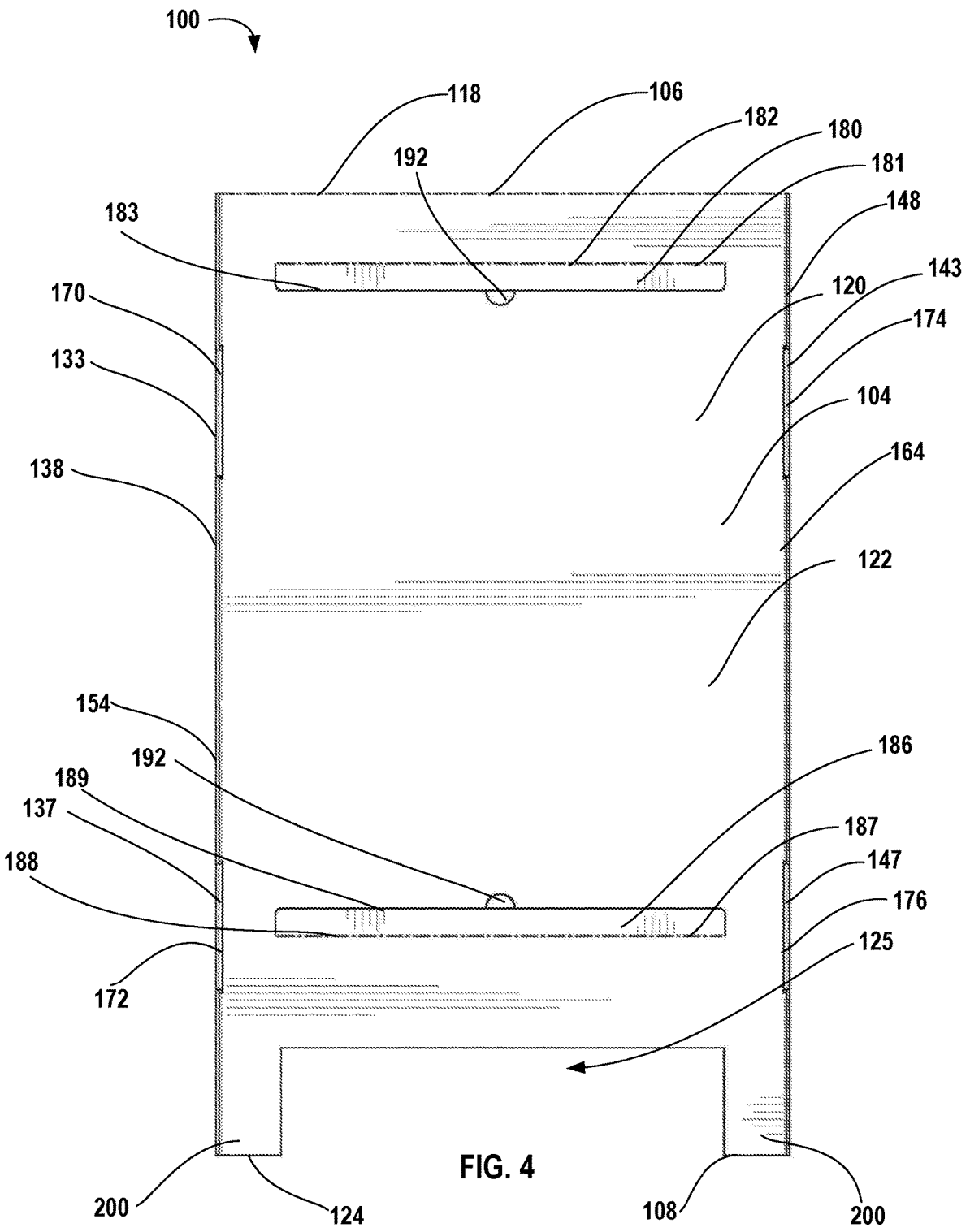
FIG. 4 illustrates a rear view of an example embodiment of the easel of FIG. 1A according to aspects disclosed herein.
Figure 5:
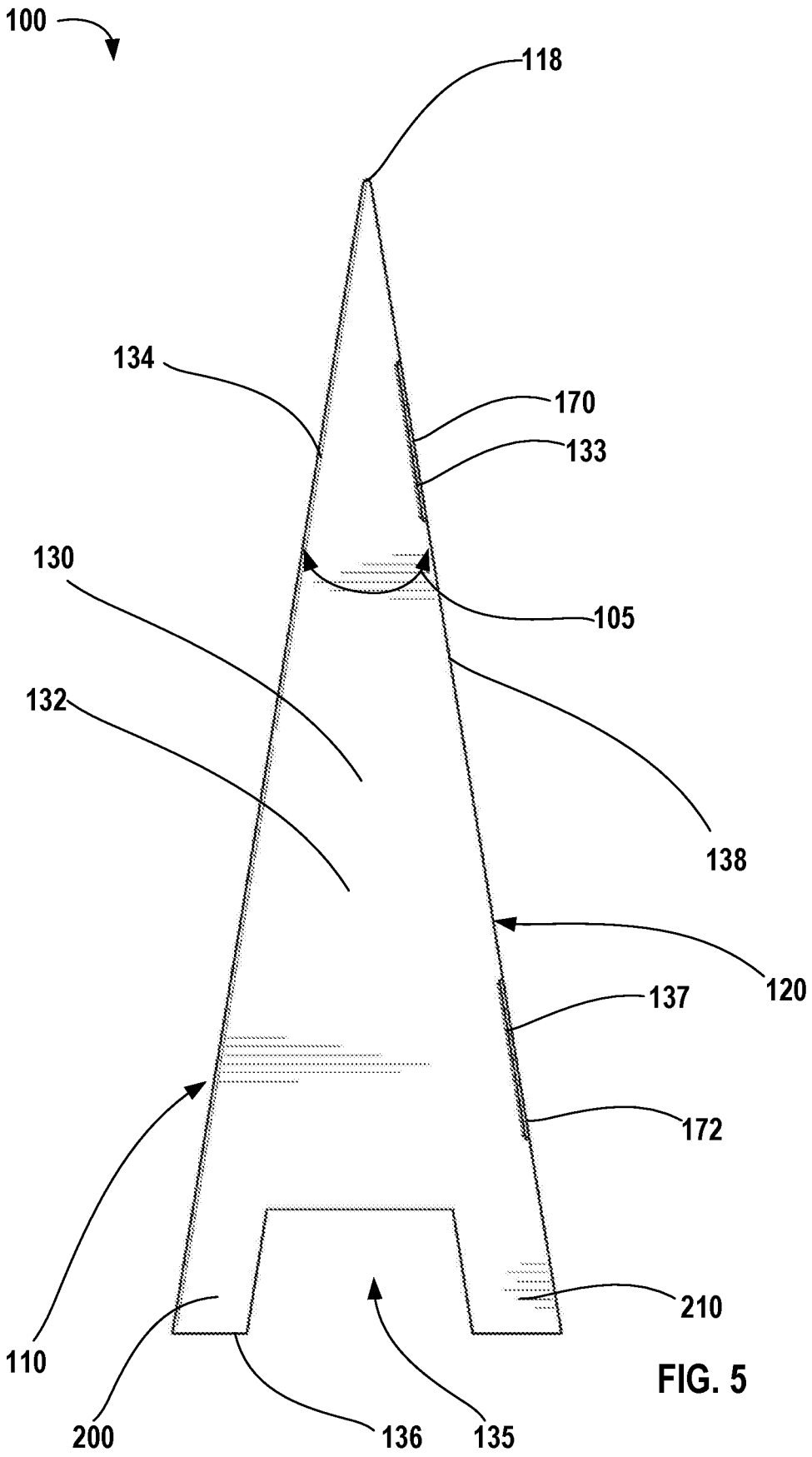
FIG. 5 illustrates a right side view of an example embodiment of the easel of FIG. 1A according to aspects disclosed herein.
Figure 6:
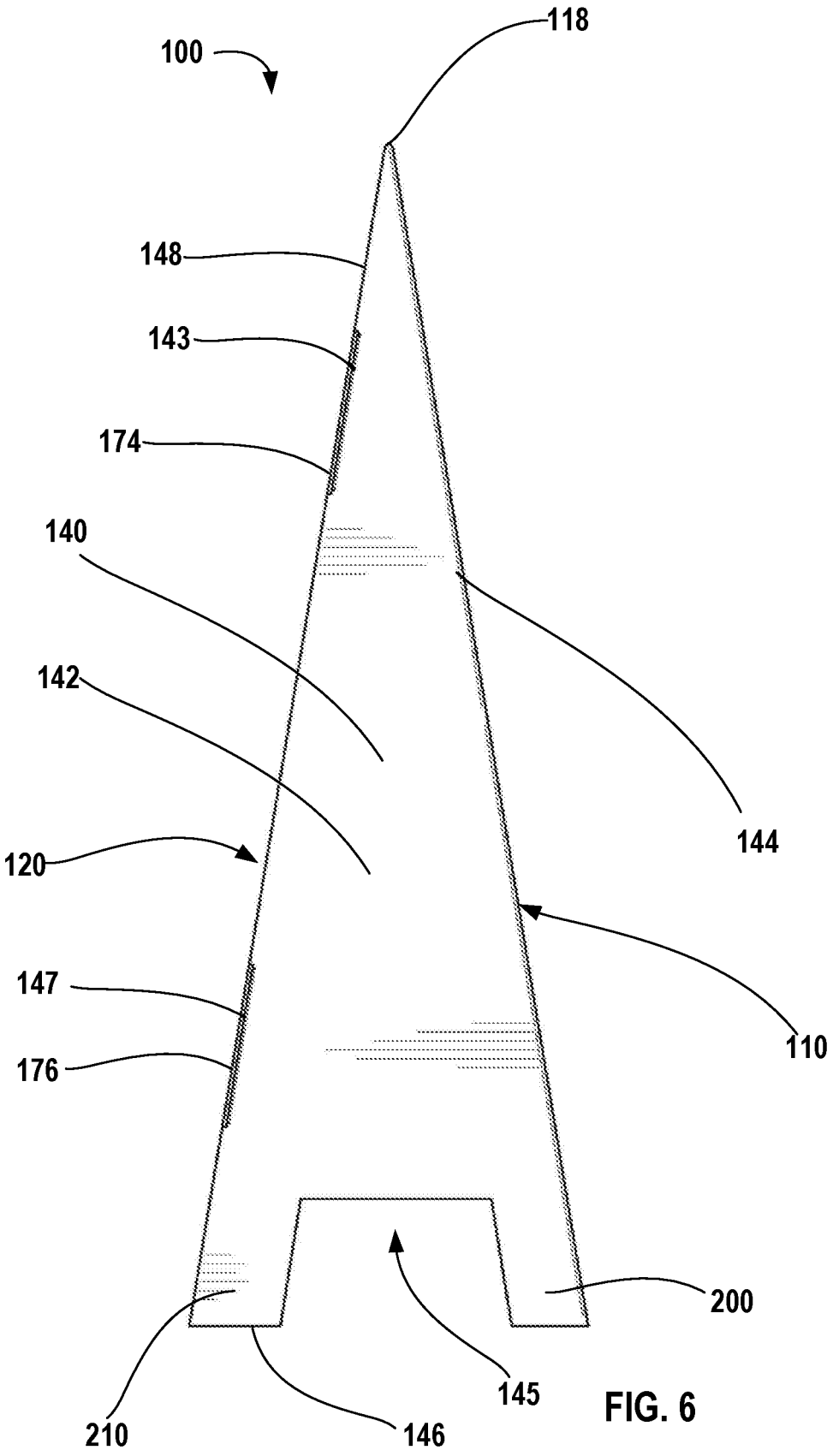
FIG. 6 illustrates a left side view of an example embodiment of the easel of FIG. 1A according to aspects disclosed herein.

The sign 10 may be any suitable size and shape depending on the needs of the user and/or the information or visual material being displayed that may be accommodated by the easel 100. In certain examples, the sign 10 may have a variety of geometric shapes and/or sizes, for example a rectangle as shown in FIGS. 2A-2B, a square, a trapezoid, or other geometric shapes. In some examples, the sign 10 may have an irregular, non-symmetrical or non-geometric shape, or a shape comprising a combination of one or more other shapes (e.g. multiple geometric shapes). In some embodiments, the sign 10 may comprise a poster type sign where the sign is formed from paper. As a non-limiting example, a poster type sign may comprise a sign 10 having a size of 18 inches wide by 25 inches in height formed from 18 pt paper or may have a size of 11 inches wide by 17 inches in height.

Figure 21:
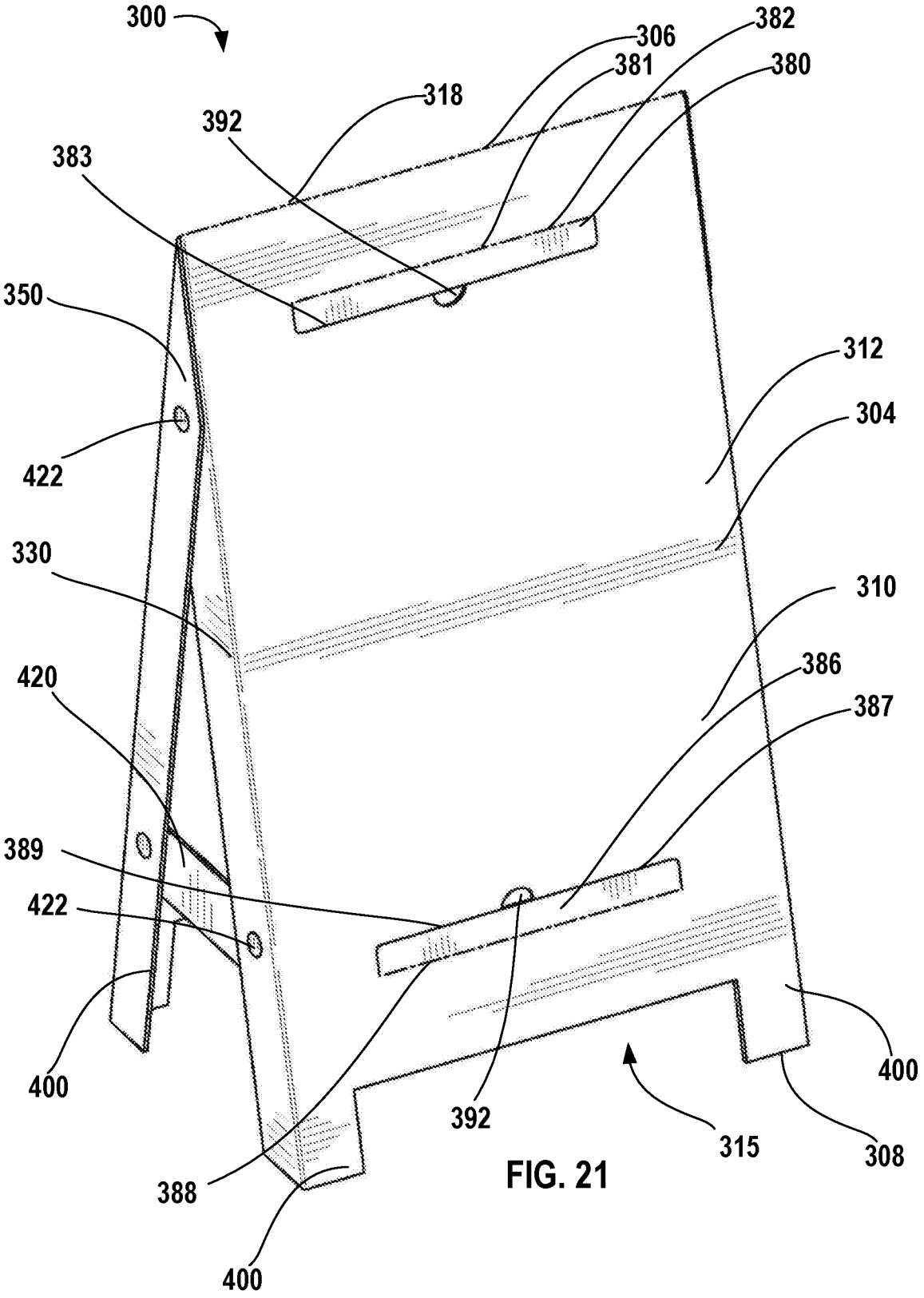
FIG. 21 illustrates a top, front, left perspective view of an alternate example embodiment of an easel of FIG. 1A according to aspects disclosed herein.
Figure 22:
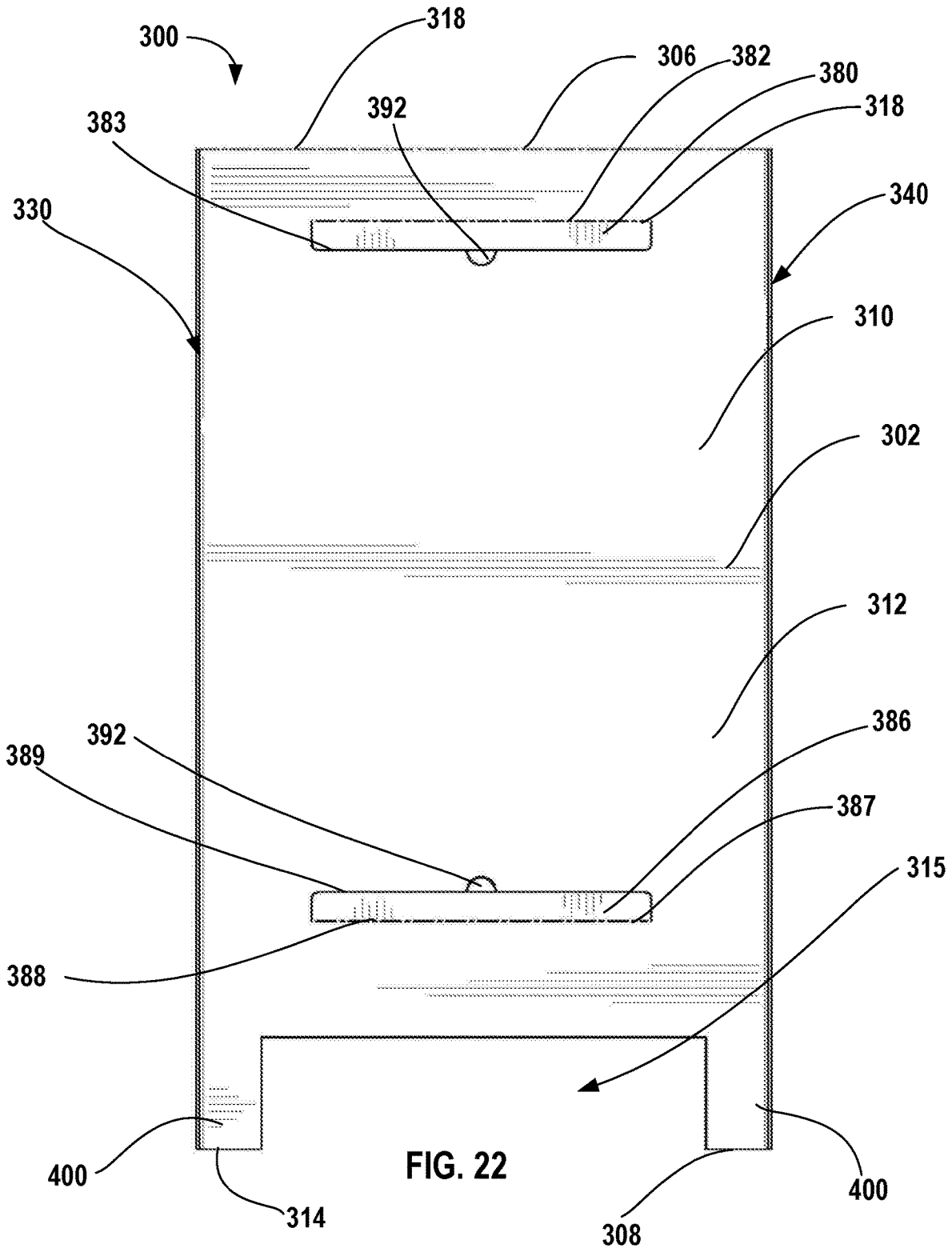
FIG. 22 illustrates a front view of an alternate example embodiment of an easel of FIG. 1A according to aspects disclosed herein.
Figure 23:
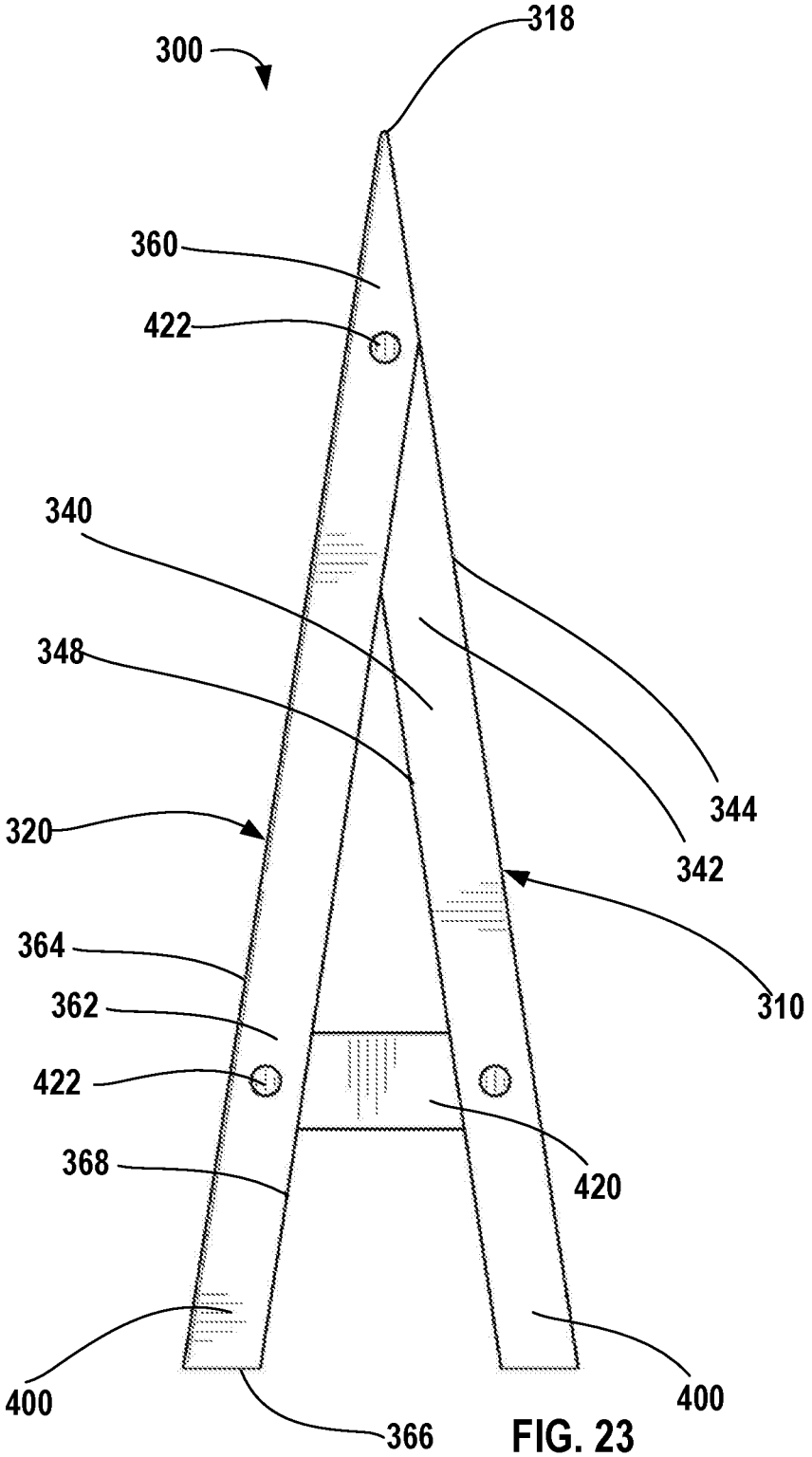
FIG. 23 illustrates a left side view of an alternate example embodiment of an easel of FIG. 1A according to aspects disclosed herein.

For easel 300 shown in FIGS. 21-23, the features are referred to using similar reference numerals under the "3xx" and "4xx" series of reference numerals, rather than "1xx" and "2xx" as used in the embodiments illustrated in FIGS. 1-20. Accordingly, certain features of the easel 300 that were already described above with respect to easel 100 of FIGS. 1-20 may be described in lesser detail, or may not be described at all. Easel 300 may have a front 302, a rear 304, a top 306, and a bottom 308 and comprise a center front panel 310, a center rear panel 320 adjacent a top edge of the center front panel 310, a left front side panel 340 adjacent the center front panel 310, a right front side panel 330 adjacent the center front panel 310 opposite the left front side panel 340, a right rear side panel 350 adjacent the center rear panel 320, a left rear side panel 360 adjacent the center rear panel 320 opposite the right rear side panel 350. The center front panel 310 and the center rear panel 320 may further include flaps 380, 386 that are configured to removably secure a sign 10 or panel that displays text or other visual information. Easel 300 may also include a brace member 420 on either or both of the left side and right side. The brace member 420 may be located on a lower half of easel 300. The brace member 420 may connect to the left front side panel 340 and the right front side panel 330 to provide a front to rear support to enable the easel 300 to form an A-frame structure. Similarly, the brace member 420 may connect to the left rear side panel 360 and the right rear side panel 350 to provide a front to rear support to enable the easel 300 for form an A-frame structure. Additionally, the left front side panel 340 may be connected directly to the left rear side panel 360 using a mechanical fastener 422 or other connection means near the top of easel 300. Similarly, the right front side panel 330 may be connected directly to the right rear side panel 350 using a mechanical fastener 422 or other connection means near the top of easel 300. In other embodiments, the brace member 420 may be connected center front panel 310 and the center rear panel 320.

In addition, the easel 300 may be formed from a plurality of pieces with the panels 310, 320, 330, 340, 350, 360 may be formed as a unitary member and the brace member(s) 420 may be formed as a separate member. The brace member(s) 420 may be attached by a mechanical connection such as a releasable or permanent mechanical fastener 422, such as screws, rivets, or other means known to one skilled in the art. In other embodiments, the brace member may be attached using a hook and loop type fastener, tape, or adhesives.

Easel 300 may have feet 400 located at each corner. The side panels 330, 340, 350, 360 may extend on a portion of the distance between the center front panel 310 and the center rear panel 320 at the bottom end 308 of easel 300 when in the presentation configuration. Each foot 400 may be formed by two perpendicular surfaces of adjacent panels.

The present disclosure is disclosed above and in the accompanying drawings with reference to a variety of examples and embodiments. The purpose served by the disclosure, however, is to provide examples of the various features and concepts related to the disclosure, not to limit the scope of the disclosure. One skilled in the relevant art will recognize that numerous variations and modifications may be made to the aspects described above without departing from the scope of the present invention, as defined by the appended claims. The claims are not to be limited to details of the preferred embodiment except as stated to exist in the claims, and definitions of claim terms are not to be used as a subterfuge to limit the claims to details of the preferred embodiments by defining claim terms narrowly such that they incorporate details of the preferred embodiment.

What is claimed is:

1. An easel comprising:

a center front panel, a center rear panel positioned adjacent a top edge of the center front panel, a left front side panel positioned adjacent the center front panel, a right front side panel positioned adjacent the center front panel opposite the left front side panel, a right rear side panel positioned adjacent the center rear panel, a left rear side panel positioned adjacent the center rear panel opposite the right rear side panel, wherein the right front side panel has a first right tab and the left front side panel has a first left tab, a first right slot positioned between the center rear panel and the right rear side panel, and a first left slot positioned between the center rear panel and the left rear side panel;

wherein each of the center front panel and the center rear panel include a pair of flaps that are oriented parallel to each other and are configured to removably secure a sign;

wherein the easel has a presentation configuration and an unfolded configuration, wherein when in the presentation configuration, the easel forms an A-frame structure, wherein the first right tab is inserted into the first right slot and the first left tab is inserted into the first left slot; and wherein when in the unfolded configuration, the center front panel and the center rear panel are arranged substantially parallel to each other.

2. The easel of claim 1, wherein each flap of the pair of flaps on the center front panel have a width that extends within a range of 60 percent and 85 percent of an overall width of the center front panel.

3. The easel of claim 1, wherein the easel is formed as a unitary member.

4. The easel of claim 1, wherein each flap of the pair of flaps on the center front panel comprises a fixed end along a flap fold line and a free end spaced away from the fixed end.

5. The easel of claim 4, wherein the flap fold line is at least partially perforated.

6. The easel of claim 4, wherein the flap fold line is a compressed region.

7. The easel of claim 1, wherein the center front panel has a thickness within a range of 0.09 inches and 0.25 inches.

8. The easel of claim 1, wherein the center front panel, the center rear panel, the left front side panel, the right front side panel, the right rear side panel, and the left rear side panel have substantially the same thickness.

9. The easel of claim 1, wherein the center front panel further comprises a lower opening between a pair of feet.

10. An easel comprising:

a center front panel comprising a substantially rectangular shape, wherein a height of the center front panel is greater than a width of the center front panel, wherein the center front panel includes an upper flap and a lower flap oriented substantially parallel to each other and configured to removably secure a sign, wherein the upper flap has a fixed end along an upper flap fold line and a free end spaced inward from the fixed end, wherein the lower flap has a fixed end along an lower flap fold line and a free end spaced inward from the fixed end, a center rear panel positioned adjacent a top edge of the center front panel and having a substantially rectangular shape, a front side panel positioned adjacent the center front panel, the front side panel having a tab;

a rear side panel positioned adjacent the center rear panel;

a slot near the center rear panel;

wherein a central fold line is arranged between the center front panel and the center rear panel, wherein the easel has a presentation configuration and an unfolded configuration, wherein when in the presentation configuration, the tab is inserted into the slot, the front side panel is positioned adjacent the rear side panel, and the easel forms an A-frame structure, and wherein when in the unfolded configuration, the center front panel and the center rear panel are substantially parallel to each other, and wherein the easel is formed as a unitary member.

11. The easel of claim 10, wherein the central fold line is at least a partially perforated region.

12. The easel of claim 10, wherein the lower flap fold line is a compressed region.

13. The easel of claim 10, wherein a distance between the upper flap fold line and the lower flap fold line is within a range of 12 inches and 32 inches.

14. The easel of claim 10, further comprising a plurality of feet arranged at each corner of the easel, wherein at least one foot of the plurality of feet is formed by a portion of the center front panel and a portion of a left side panel.

15. The easel of claim 14, wherein a first foot of the plurality of feet is separated from a second foot by a lower central opening on the center front panel.

16. An easel comprising:

a center front panel, a center rear panel positioned adjacent a top edge of the center front panel, a left front side panel positioned adjacent the center front panel, a right front side panel positioned adjacent the center front panel opposite the left front side panel, a right rear side panel positioned adjacent the center rear panel, a left rear side panel positioned adjacent the center rear panel opposite the right rear side panel, wherein the right front side panel has a first right tab and the left front side panel has a first left tab, a first right slot positioned between the center rear panel and the right rear side panel, and a first left slot positioned between the center rear panel and the left rear side panel, wherein the center front panel includes an upper flap and a lower flap oriented substantially parallel to each other and configured to removably secure a first sign, wherein the upper flap has a fixed end along an upper flap fold line and a free end spaced inward from the fixed end, wherein the lower flap has a fixed end along a lower flap fold line and a free end spaced inward from the fixed end, wherein the center rear panel includes an upper flap and a lower flap oriented substantially parallel to each other and configured to removably secure a second sign, wherein the upper flap has a fixed end along an upper flap fold line and a free end spaced inward from the fixed end, wherein the lower flap has a fixed end along an lower flap fold line and a free end spaced inward from the fixed end, wherein the easel has a presentation configuration and an unfolded configuration, wherein when in the presentation configuration, the easel forms an A-frame structure wherein the first right tab is inserted into the first right slot and the first left tab is inserted into the first left slot, and wherein when in the unfolded configuration, the center front panel and the center rear panel are substantially parallel to each other.

17. The easel of claim 16, wherein the center front panel, the center rear panel, the left front side panel, the right front side panel, the right rear side panel, and the left rear side panel have substantially the same thickness.

18. The easel of claim 16, wherein the easel is formed as a unitary member.

19. The easel of claim 16, wherein the easel comprises a plurality of primary feet arranged at each corner of the easel and a plurality of secondary feet arranged on a left side of the easel and a right side of the easel.

20. The easel of claim 19, wherein at least one foot of the plurality of primary feet is formed by a portion of the center front panel and a portion of the left front side panel, and at least one foot of the plurality of secondary feet is formed by a portion of the left front side panel.

* * * * *